US006877784B2

(12) United States Patent
Kelley et al.

(10) Patent No.: US 6,877,784 B2
(45) Date of Patent: Apr. 12, 2005

(54) TILT LATCH MECHANISM FOR HUNG WINDOWS

(75) Inventors: Timothy J. Kelley, Stillwater, MN (US); David R. Bogenhagen, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 68 days.

(21) Appl. No.: 10/138,433

(22) Filed: May 3, 2002

(65) Prior Publication Data

US 2003/0205903 A1 Nov. 6, 2003

(51) Int. Cl.[7] ..... E05C 3/04

(52) U.S. Cl. ..... 292/241; 292/35; 292/47; 292/141; 292/DIG. 20; 292/DIG. 35; 292/DIG. 37; 292/DIG. 47; 49/161

(58) Field of Search ..... 292/142, DIG. 37, 292/DIG. 47, 241, 34, 38, 141, DIG. 20, DIG. 35

(56) References Cited

U.S. PATENT DOCUMENTS

| | | | | | |
|---|---|---|---|---|---|
| 336,302 | A | * | 2/1886 | Dudgeon | 292/36 |
| 480,148 | A | * | 8/1892 | Theby | 292/36 |
| 1,041,803 | A | * | 10/1912 | Kilburn | 292/36 |
| 2,094,990 | A | | 10/1937 | Lang | |
| 2,710,216 | A | | 6/1955 | Eichacker | |
| 2,934,370 | A | * | 4/1960 | Love et al. | 292/142 |
| 3,085,299 | A | | 4/1963 | Reynaud | |
| 3,582,122 | A | | 6/1971 | Foster et al. | |
| 3,795,076 | A | | 3/1974 | Anderson | |
| 3,907,348 | A | * | 9/1975 | Bates et al. | 292/220 |
| 4,005,886 | A | | 2/1977 | Lirette | |
| 4,099,753 | A | | 7/1978 | Gwozdz et al. | |
| 4,167,835 | A | | 9/1979 | Nobes et al. | |
| 4,420,905 | A | | 12/1983 | Kucharczyk | |
| 4,553,353 | A | | 11/1985 | Simpson | |
| 4,578,903 | A | | 4/1986 | Simpson | |
| 4,622,778 | A | | 11/1986 | Simpson | |
| 4,624,073 | A | | 11/1986 | Randall | |
| 4,801,164 | A | * | 1/1989 | Mosch | 292/204 |
| 4,901,475 | A | | 2/1990 | Simpson | |
| 4,961,286 | A | | 10/1990 | Bezubic | |
| 5,090,750 | A | * | 2/1992 | Lindqvist | 292/7 |
| 5,110,165 | A | * | 5/1992 | Piltingsrud | 292/242 |
| 5,165,737 | A | | 11/1992 | Riegelman | |
| 5,169,205 | A | * | 12/1992 | James | 296/146.16 |
| 5,244,238 | A | | 9/1993 | Lindqvist | |
| 5,301,989 | A | | 4/1994 | Dallmann et al. | |
| 5,398,447 | A | | 3/1995 | Morse | |
| 5,531,492 | A | | 7/1996 | Raskevicius | |
| RE35,463 | E | * | 2/1997 | Vetter et al. | 292/48 |
| 5,618,067 | A | | 4/1997 | Carlson et al. | |
| 5,636,475 | A | | 6/1997 | Nidelkoff | |
| 5,653,485 | A | * | 8/1997 | Campbell | 292/241 |
| 5,715,631 | A | | 2/1998 | Kailian et al. | |
| 5,791,700 | A | | 8/1998 | Biro | |
| 5,992,907 | A | | 11/1999 | Sheldon et al. | |
| 6,021,603 | A | | 2/2000 | Prete et al. | |
| 6,139,071 | A | * | 10/2000 | Hopper | 292/158 |
| 6,155,615 | A | | 12/2000 | Schultz | |
| 6,183,024 | B1 | * | 2/2001 | Schultz et al. | 292/175 |
| 6,347,820 | B2 | * | 2/2002 | Subliskey | 292/346 |
| 6,412,834 | B1 | * | 7/2002 | Waitai et al. | 292/197 |
| 6,485,070 | B1 | * | 11/2002 | Schultz | 292/175 |
| 6,588,150 | B1 | * | 7/2003 | Wong et al. | 49/183 |

FOREIGN PATENT DOCUMENTS

| | | | |
|---|---|---|---|
| GB | 2221244 | * | 1/1990 |

* cited by examiner

*Primary Examiner*—John B. Walsh
*Assistant Examiner*—Carlos Lugo
(74) *Attorney, Agent, or Firm*—Womble Carlyle Sandridge & Rice, PLLC

(57) ABSTRACT

A dual function lock for use on a hung window is provided that includes a base, a handle and a tilt latch actuating mechanism. A tilt latch for use on a hung window is also provided. Furthermore, a tilt latch assembly including a lock, left and right latches and an extensible member is provided. Furthermore, a hung window and tilt latch assembly is provided.

5 Claims, 30 Drawing Sheets

TILT LATCH MECHANISM FOR HUNG WINDOWS

FIELD OF THE INVENTION

The invention relates to tilt latch mechanisms for hung windows.

BACKGROUND OF THE INVENTION

In tiltable hung windows, a pair of latches are often used to prevent the sash from tilting except when desired. Actuation of the latches allows the operator to tilt the sash out of the plane of the frame. In the background art, movement of the sash from its tilted to non-tilted position is accomplished either by the tilt latches being actuated by a ramp, that is integral to the tilt latch, striking the frame, or by the operator manually holding the latches in a position so the latches will not strike the frame.

Figure 1:
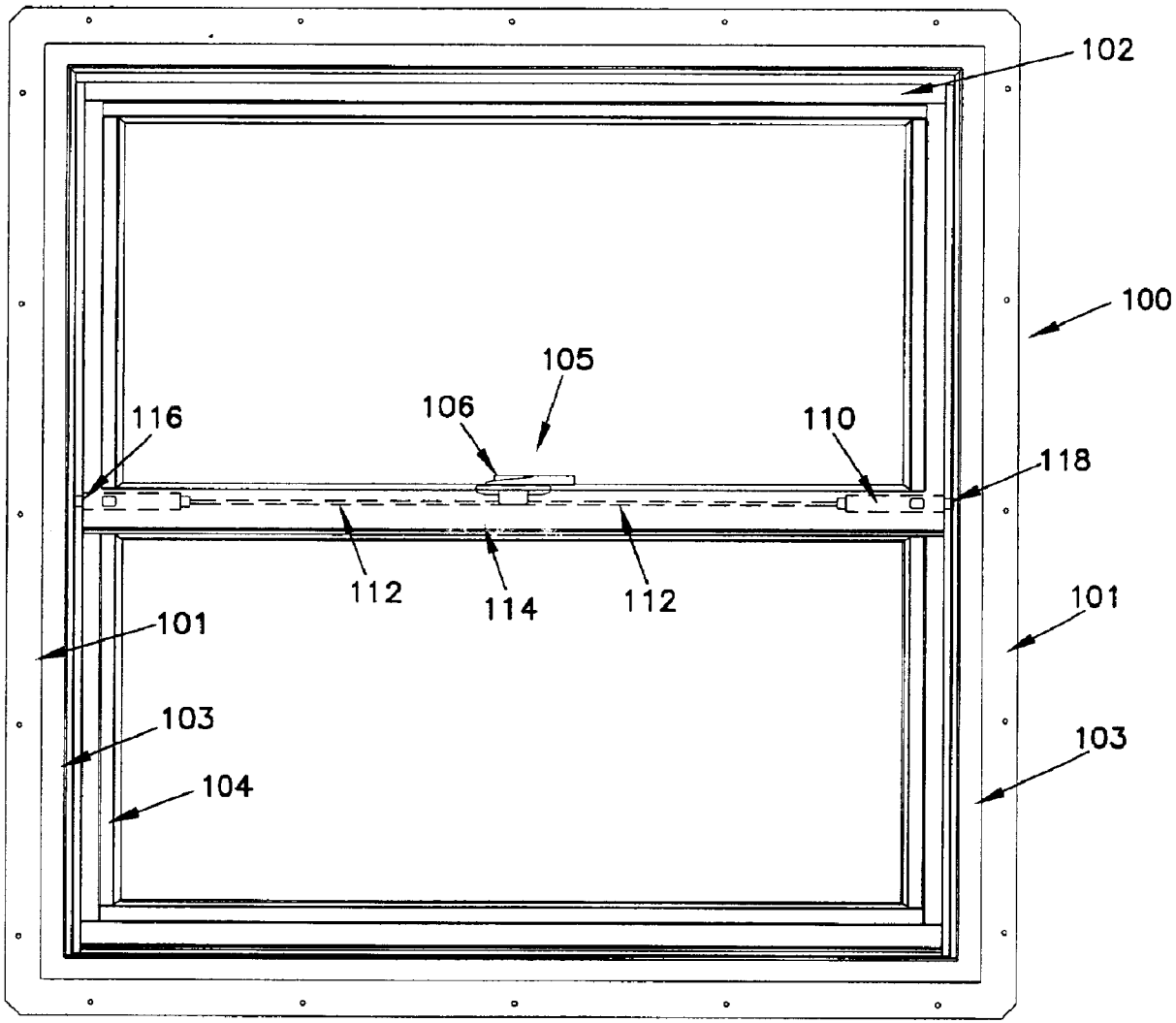
FIG. 1 is a front view of a window and a tilt latch assembly according to the principles of the present invention.
Figure 2:
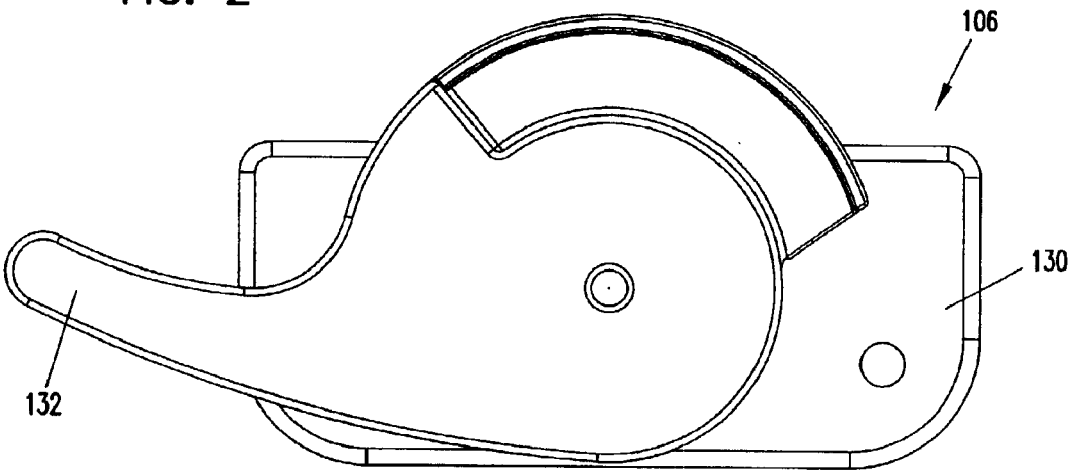
FIG. 2 is a top view of a lock according to the principles of the present invention.
Figure 3:
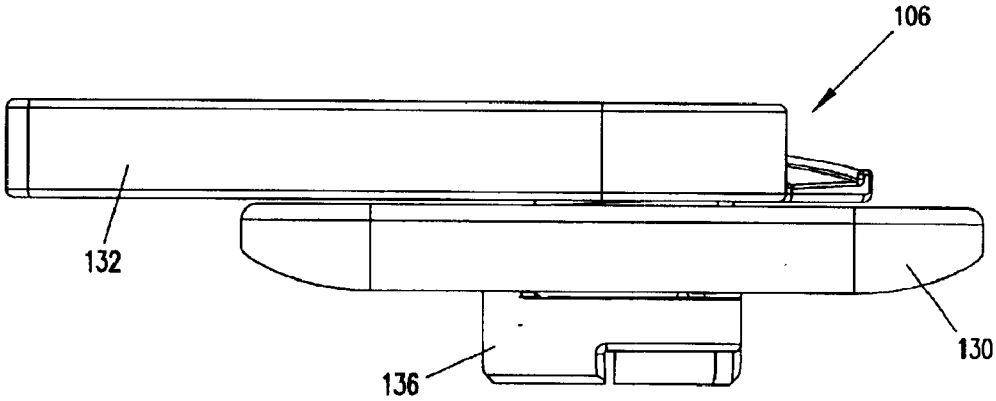
FIG. 3 is a side view of a lock according to the principles of the present invention.
Figure 4:
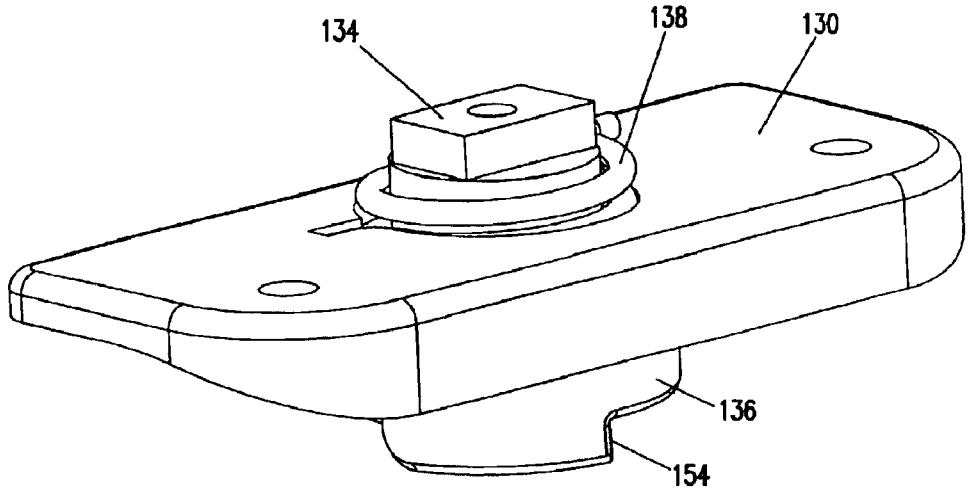
FIG. 4 is a top perspective view of a portion of a lock, not including the handle, according to the principles of the present invention.
Figure 5:
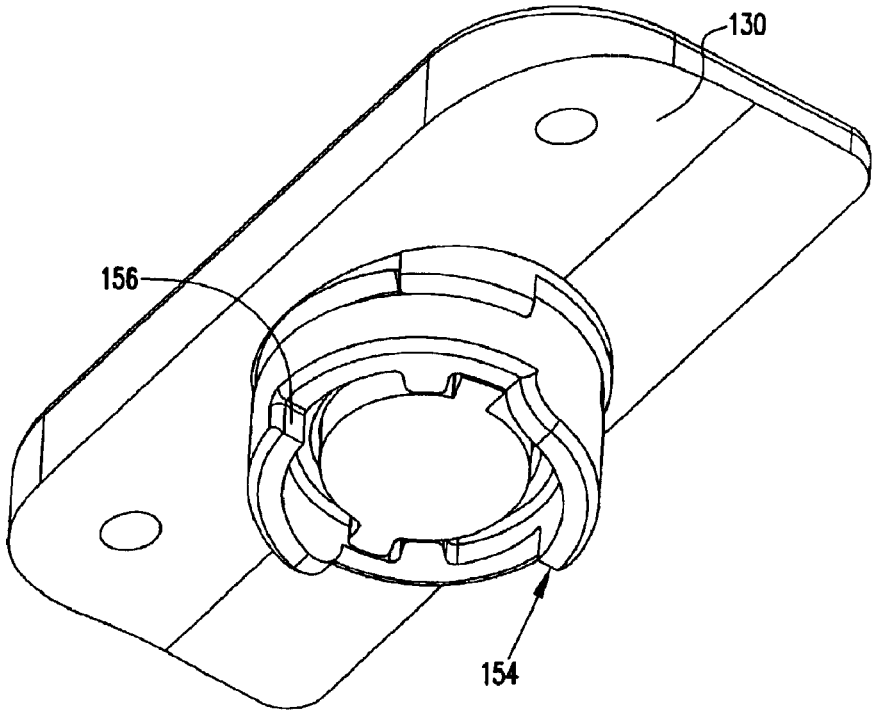
FIG. 5 is a bottom perspective view of a lock according to the principles of the present invention.
Figure 6:
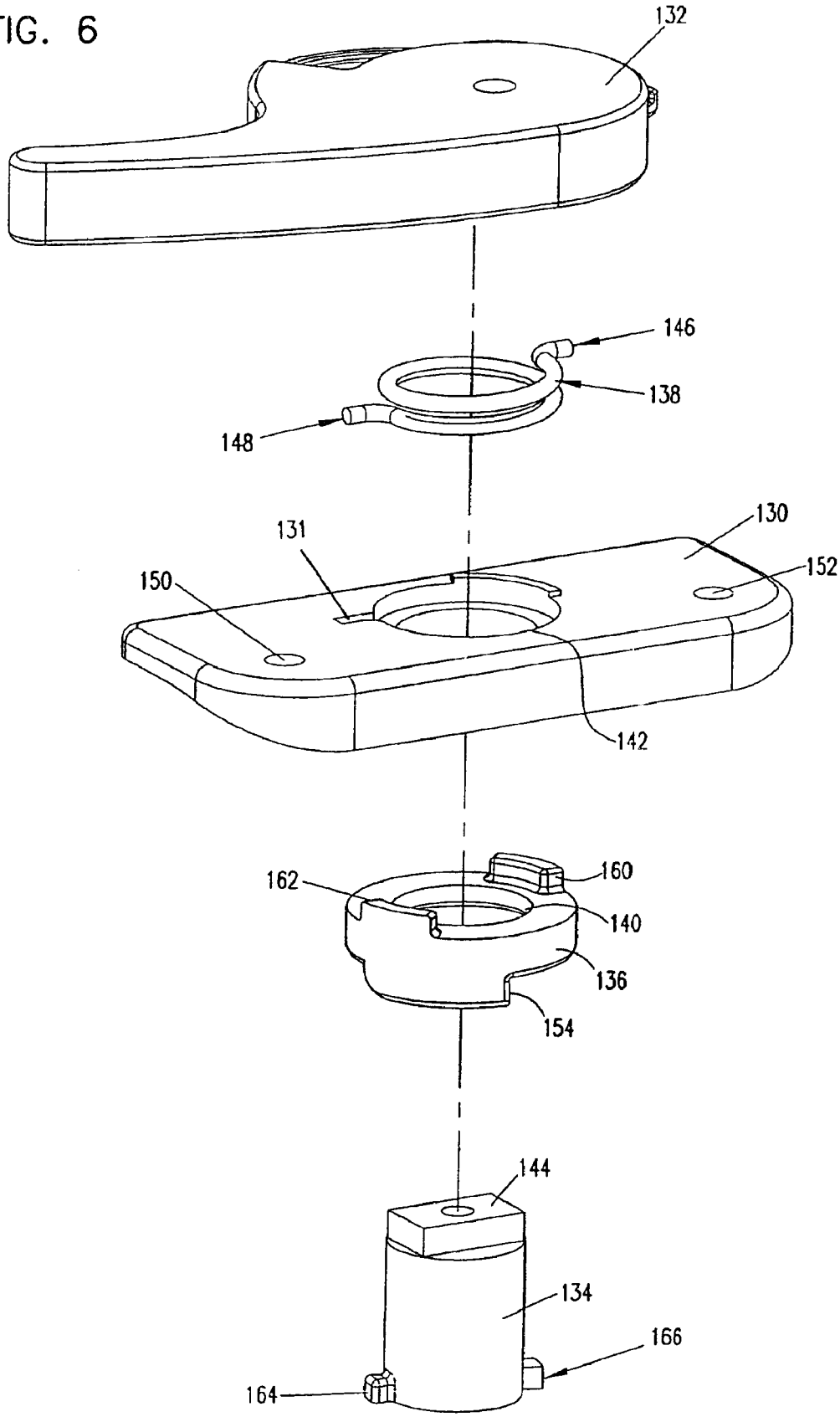
FIG. 6 is an exploded view of a lock according to the principles of the present invention.

While the invention is amenable to many modifications and alternative forms, specifics thereof have been shown by way of example in the drawings and will be described in detail. It should be understood, however, that the intention is not to limit the invention to the particular embodiments described. On the contrary, the intention is to cover all modifications, equivalents and alternatives following within the spirit and the scope of the invention as defined by the appended claims.

DETAILED DESCRIPTION

The present invention relates to a tilt latch assembly to be attached to the sash of a tiltable hung window. The tilt latch assembly allows the operator to prevent the sash from tilting during normal sliding operation of the sash in the frame. The tilt latch assembly also allows the operator to retract the latch ends and therefore allow for tilting of the sash. Furthermore, the tilt latch assembly has a self-tripping feature in which return of the sash from its tilted to non-tilted position results in automatic return of the latch ends to a position of engagement with the frame or a component attached to the frame such that further unwanted tilting is prevented.

In one embodiment of the present invention, the lock associated with the tilt latch assembly has a dual function in that it is also capable of locking with the bottom rail of an upper sash to prevent the upper and lower sashes from sliding in the frame.

A hung window is any window that includes a frame and a sash wherein the sash slides within the frame or within a component attached to the frame such as a jambliner. A hung window may have only a single sliding sash or it may have two or more sliding sashes.

FIG. 1 illustrates a front view of a double hung window as viewed from the inside of a building. Window 100 includes a frame 101, an upper sash 102, and a lower sash 104. Sashes 102 and 104 are capable of sliding up and down in the frame 101.

A tilt latch assembly 105 comprising a lock 106, right tilt latch 108, left tilt latch 110 and extensible member 112 connecting the lock 106 to the right and left tilt latches is shown attached to the top rail 114 of the lower sash 104. Typically, a tilting sash pivots about a point located near the bottom of the sash. That is why the tilt latch assembly 105 is attached to the upper rail of the sash. However, it is noted that it is within the scope of this invention to have a sash that pivots to tilt around some other point, such as for example, the upper rail. In such a case the tilt latch assembly may be attached to some other point such as the lower rail of the sash.

Right tilt latch 108 and left tilt latch 110 include latch ends 116 and 118 respectively that extend into a slot in the jambliner 103 which is attached to the frame 101. When extended, the latch ends 116 and 118 prevent the sash 104 from tilting.

The components of one embodiment lock of the present invention will first be discussed in conjunction with FIGS. 2–8. Then the components of one embodiment tilt latch and extensible member connecting the lock to tilt latches will be discussed in conjunction with FIGS. 9–10. Lastly, the operation of one embodiment of the tilt latch assembly will be discussed in conjunction with FIGS. 11–31.

A lock in accordance with the invention includes a base, a handle and a tilt latch actuating mechanism. The base of the currently described embodiment is adapted to be attached to a rail of a sash. The handle is rotatably connected to the base. The handle has at least a first position and a second position. The tilt latch actuating mechanism is connected to the handle, either directly or indirectly. The tilt latch actuating mechanism is adapted to receive an extensible member.

A tilt latch actuating mechanism has a null zone between the first and second positions of the handle. A null zone refers to a zone in the rotation of the handle wherein the tilt latch actuating mechanism has the capability of having a portion of the tilt latch actuating mechanism rotate while the extensible member has no substantial movement. What is meant by the terminology "no substantial movement" with regard to the extensible member is that there is no purposeful longitudinal movement in the extensible member. There may be vibrations and other small movements in the extensible member and yet qualify as "no substantial movement". Once the tilt latch actuating mechanism leaves the null zone such that the handle is rotated from the second position to a tilt position, the tilt latch actuating mechanism operates to cause the extensible member to move in a direction toward the lock. In the dual lock of FIGS. 2–6, the null zone corresponds with the zone between locking and unlocking the lower sash to the upper sash. That is, there is no substantial movement in the extensible member as the handle is moved from the locked position to the unlocked position as will be further described below.

Various views of one embodiment dual function lock in accordance with the principles of the present invention are provided in FIGS. 2–8. Lock 106 includes a base 130, handle 132, shaft 134, drive member 136 and torsion spring 138. Shaft 134 is received by opening 140 in drive member 136 and opening 142 in base 130. End 144 of shaft 134 is attached to handle 132 so that rotation of handle 132 causes rotation of shaft 134.

Torsion spring 138 is situated between the base 130 and the handle 132. End 148 of torsion spring 138 is attached to base 130 at 131. Opposite end 146 is situated on surface 149 and interacts with features 143, 145 and 147. Base 130 is attached to a rail of a sash by some fastening means such as screws through holes 150 and 152. Therefore, rotation of handle 132 results in a torsional force on the handle 132 only during a portion of the motion when end 146 is adjacent stopping surface 147. Note that in this embodiment the end 146 is adjacent stopping surface 147 when in the "unlocked" position and in the "release" position. These positions will be discussed further below.

Dual member 136 includes a drive surface that includes two drive surfaces 154 and 156. Drive surfaces 154 and 156 interact with an extensible member to cause the extensible to move in a direction toward the lock. A drive surface may be any shape that is capable of causing the extensible member to move. While the drive surface of the embodiments shown in the figures includes two surfaces 154 and 156, the invention is not so limited and could be one or wore surfaces.

Drive member 136 also includes a cog engaging surface that in this embodiment includes two surfaces 160 and 162. A cog engaging surface may be any shape that is capable of interacting with a protrusion on a shaft such that, when engaged, rotation of the shaft results in rotation of the drive member. While the cog-engaging surface of the embodiment shown in the figures includes two surfaces 160 and 162, the invention is not so limited and could be one or more surfaces.

Shaft 134 includes cogs 164 and 166. A cog is a protrusion capable of engaging a cog-engaging surface.

Figure 7:
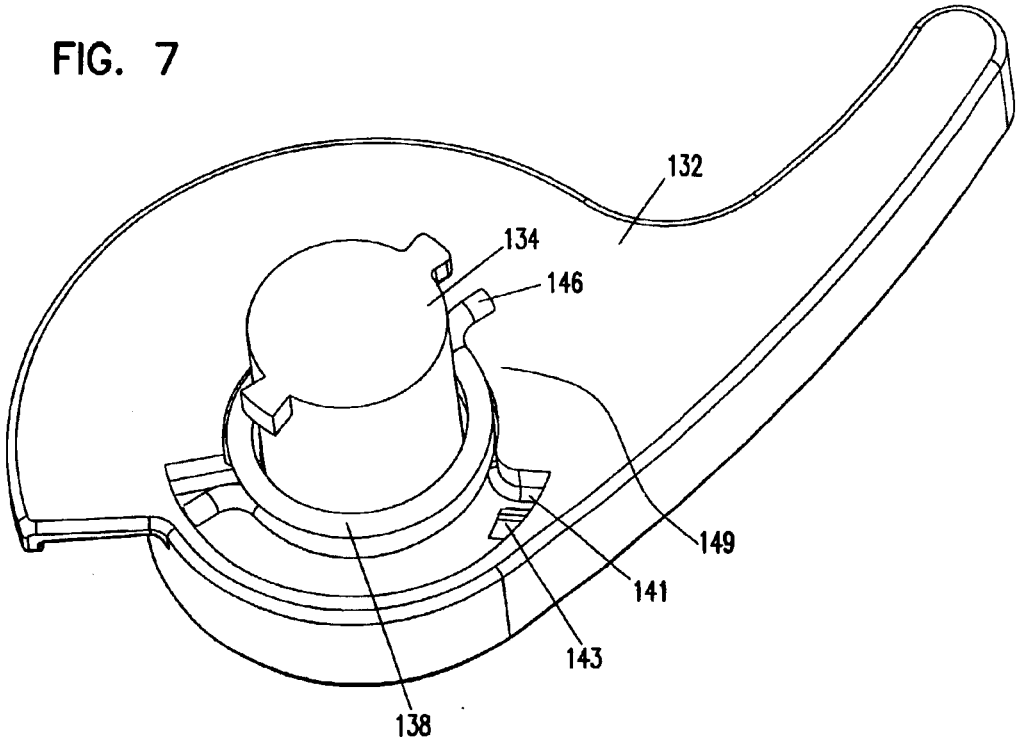
FIG. 7 is a bottom perspective view of a portion of a lock according to the principles of the present invention with associated torsion spring and shaft shown in the unlocked position.
Figure 8:
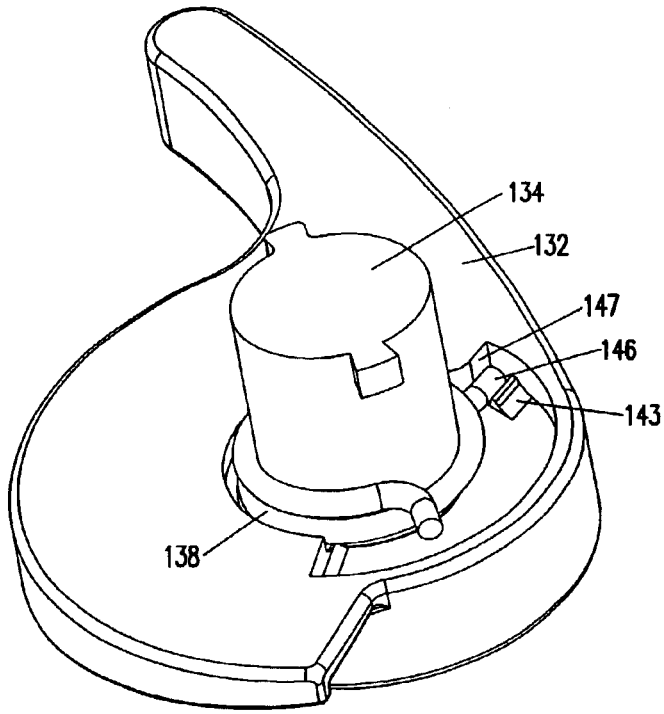
FIG. 8 is a bottom perspective view of a portion of a lock according to the principles of the present invention with the associated torsion spring and shaft shown in the unlocked position.

FIGS. 7 and 8 are bottom perspective views of the handle 132, shaft 134 and spring 138. FIG. 7 shows the positioning when the handle 132 is in the locked position which may also be referred to as the zero degree position. Note that reference throughout this application to positions of a specific number of degrees is referring to the position of the handle relative to its locked position. Also note that the use of specific degree positions are expressed as only one embodiment. Different degree positions than expressed here as examples, may be utilized while staying within the scope of the present invention.

FIG. 8 shows the positioning when the handle 132 is in the 180 degree open/tilt position. The underside of handle 132 includes a notch 141 that includes a detent 143. Spring end 146 is shown in FIG. 7 on surface 149 of the handle 132 (not yet in the notch 141). In the open/tilt position of FIG. 8, the spring end 146 is located in the notch 141 between the stopping surface 147 and the detent 143. Operation of the detent will be described in the operations section below.

All of the parts of the lock 106 are made of any material capable of structurally performing the tasks set forth herein. Some suitable materials, but certainly not the only materials that may be used, are now listed. The handle 132 may be metal or plastic. The spring 138 may be stainless steel or a music wire spring. Base 130 may be brass over a plastic subcomponent or it may be a solid plastic part. Drive member 136 and shaft 134 may be polypropylene, injection molded metal, or plastic.

Turning now to a discussion of a tilt latch according to the principles of the present invention. A tilt latch includes a housing, a slider member slidably received by the housing to move in a linear motion, a spring, and a trigger member. A housing is a member capable of being attached to a window sash and having a first spring engagement surface. A slider member is any member capable of sliding in a housing. Many different shapes may be utilized for a slider member. A slider member is adapted to be connected to an extensible member such that movement of the extensible member moves the slider member through a linear motion. A slider member includes a latch end adapted to engage one or both of a groove in a window frame and a groove in a component attached to a window frame. A slider member slides in an extending direction and in an opposite nonextending direction. A slider member includes a second spring engagement surface that is substantially parallel to the first spring engagement surface on the housing and substantially perpendicular to the sliding movement of the slider member. The spring is positioned between the first and second spring engagement surfaces.

The trigger member is connected to the housing such that a button of the trigger member is capable of protruding outside the housing in a direction substantially perpendicular to the sliding movement of the slider member. A trigger member includes a slider locking surface that is substantially perpendicular to the sliding movement of the slider member. A slider locking surface is any surface capable of preventing the slider from moving in the locking direction when engaged with the slider member.

Figure 9:
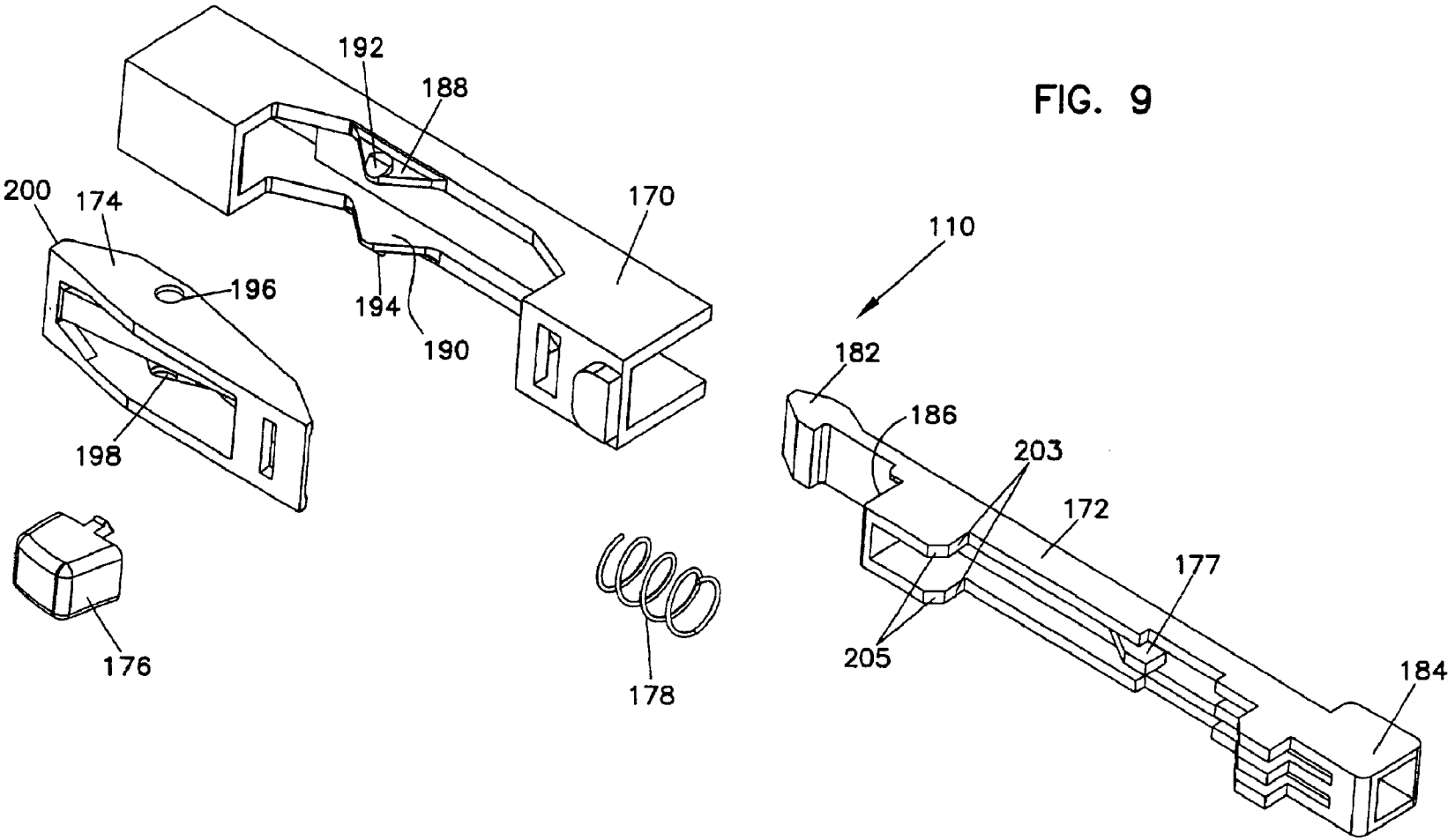
FIG. 9 is an exploded perspective view of a tilt latch according to the principles of the present invention.
Figure 10:
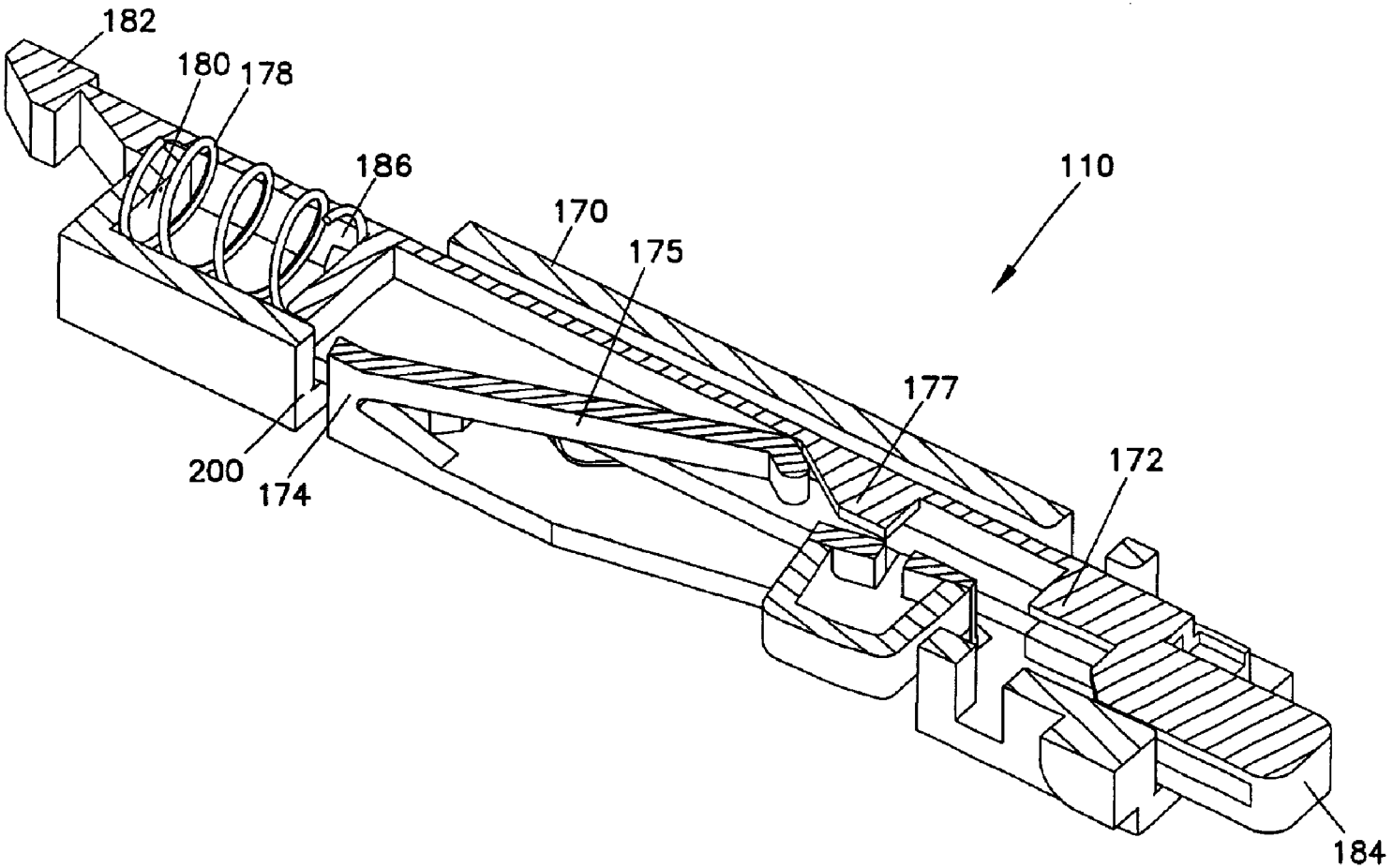
FIG. 10 is a perspective cutaway view of a tilt latch according to the principles of the present invention in the locked position.

One embodiment tilt latch is shown in FIGS. 9 and 10. FIG. 9 is an exploded view of tilt latch 110 and FIG. 10 is an assembled cutaway view.

Tilt latch 110 includes housing 170, slider member 172, one form of a trigger member, namely lever member 174 including button 176, and spring 178. All of the parts of the tilt latch 110 are made of any material capable of structurally performing the tasks set forth herein. Some suitable materials, but certainly not the only materials that may be used, are now listed. The housing 170 and the slider member 172 may be plastic or metal. The lever member 174 and button 176 may be plastic. The spring 178 may be stainless steel or music wire spring. Certainly, one skilled in the art could make minor accommodations for the use of different materials than those mentioned here. Such other materials are certainly considered to be within the scope of this invention.

Housing 170 includes first spring engagement surface 180 (see FIG. 10). Slider member 172 includes second spring engagement surface 186. Slider member 172 includes inside end 182 and opposite latch end 184. Slider 172 is capable of attaching to an extensible member such that the extensible member can pull the slider member in a direction toward an associate lock such that the spring 178 is compressed between the first and second spring engaging surfaces 180 and 186 respectively. Alternatively, the user could manually actuate the slider member 172 toward the non-extended position while remaining within the scope of the invention. The extensible member may be attached at any point on the slider 172. For example, in the provided design of the Figures, the extensible member is attached to the slider 172 at latch end 184. In another embodiment the extensible member may be attached to the inside end 182. Certainly other attachment locations are considered within the scope of the present invention.

Lever member 174 is pivotally connected to the housing 170 at supports 188 and 190. Protrusions 192 and 194 on supports 188 and 190 respectively are received in openings 196 and 198 in the lever member 174. Lever member is capable of pivoting such that button 176 extends outside of housing 170 in a direction substantially perpendicular to the sliding motion of slider member 172. This position of button 176 is referred to as the protruding position. Lever member 174 is also capable of pivoting to a position in which button 176 is in a retracted position.

Lever member 174 also includes a slider locking surface 200 capable of preventing the slider member 172 from sliding in the locking direction when the button is in the protruding position by engagement of the slider locking surface 200 with the surface 203 of the slider member 172. Surface 203 includes tapered incline 205.

Lever member 174 also includes a lever spring 175 that interacts with ramp 177 when the slider member 172 is moved in an unlocking direction.

FIGS. 11–31 show the operation of one embodiment tilt latch assembly according to the principles of the present invention.

Figure 11:
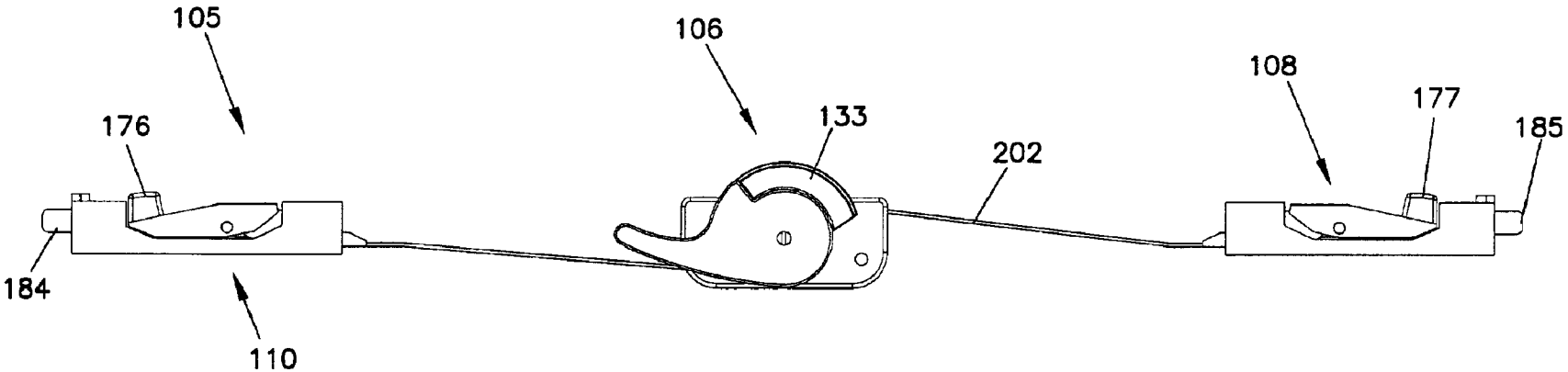
FIG. 11 is a top view of a tilt latch assembly in the locked position according to the principles of the present invention.
Figure 12:
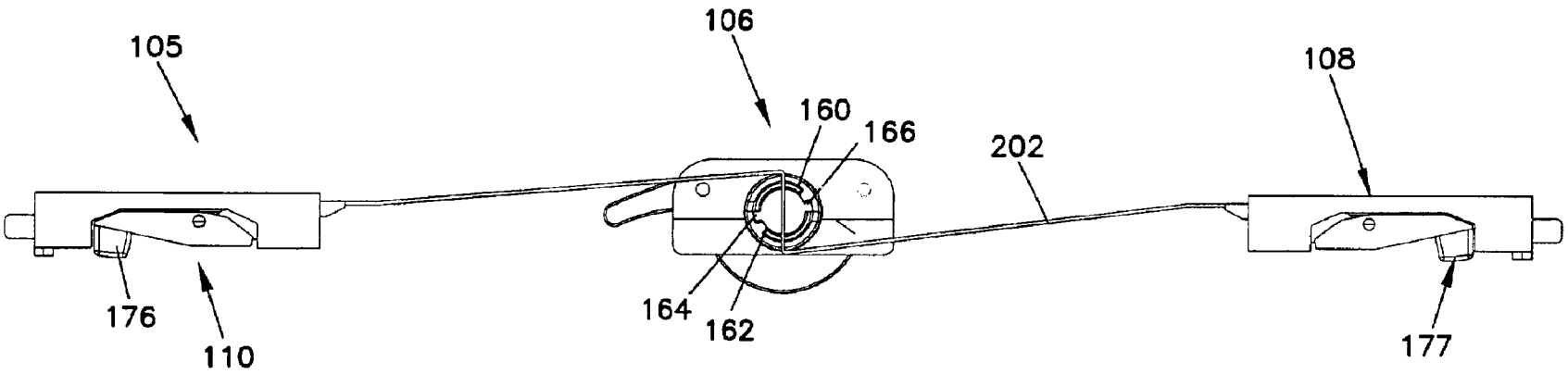
FIG. 12 is a bottom view of a tilt latch assembly in the locked position according to the principles of the present invention.
Figure 13:
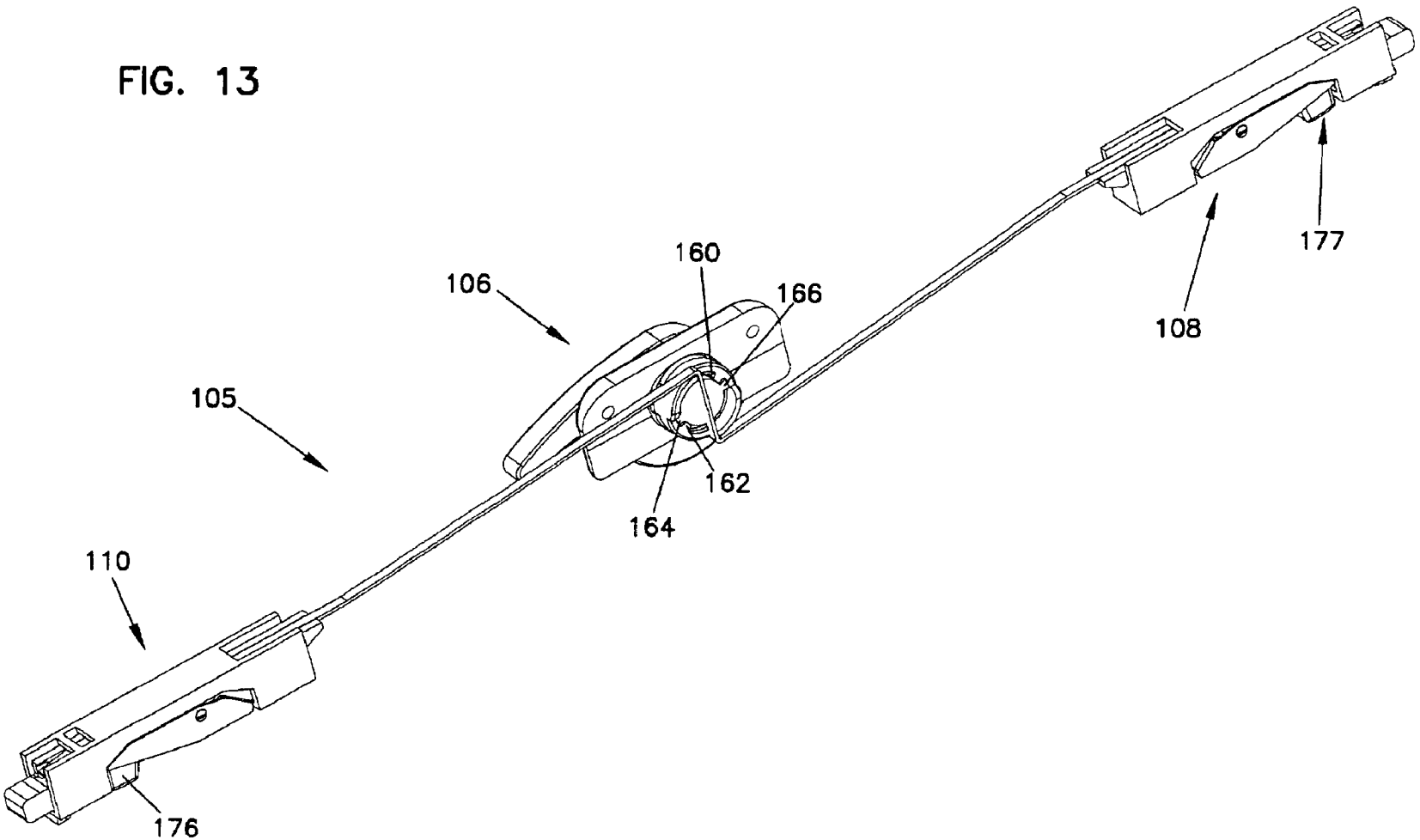
FIG. 13 is a bottom perspective view of a tilt latch assembly in the locked position according to the principles of the present invention.

FIGS. 11–13 show different views of the tilt latch assembly 105 in a "locked" position. In this position the locking edge 133 of handle 132 is in a position in which it may engage a keeper on a lower rail of an upper sash such as for example upper sash 102 to prevent upper and lower sashes 102 and 104 from sliding in the frame. In this locked position, the latch ends 184 and 185 are extended so as to be capable of engaging a groove in a jambliner or in a groove in the frame itself. Therefore, in the locked position, the window sash to which this assembly 105 would be attached is prevented from tilting. It is noted in FIGS. 12 and 13 that the cogs 164 and 166 are not engaged (in contact with) cog engaging surfaces 160 and 162. It is also noted that buttons 176 and 177 are in retracted positions.

An extensible member is any member capable of transferring force from a lock to a tilt latch. One embodiment extensible member is shown in FIGS. 11–31 as cable tie 202. Another embodiment extensible member is a fabric cord such as, for example, a nylon cord. The length of the extensible member depends on the distance between the latches and the lock which depends on the size of the window.

Figure 14:
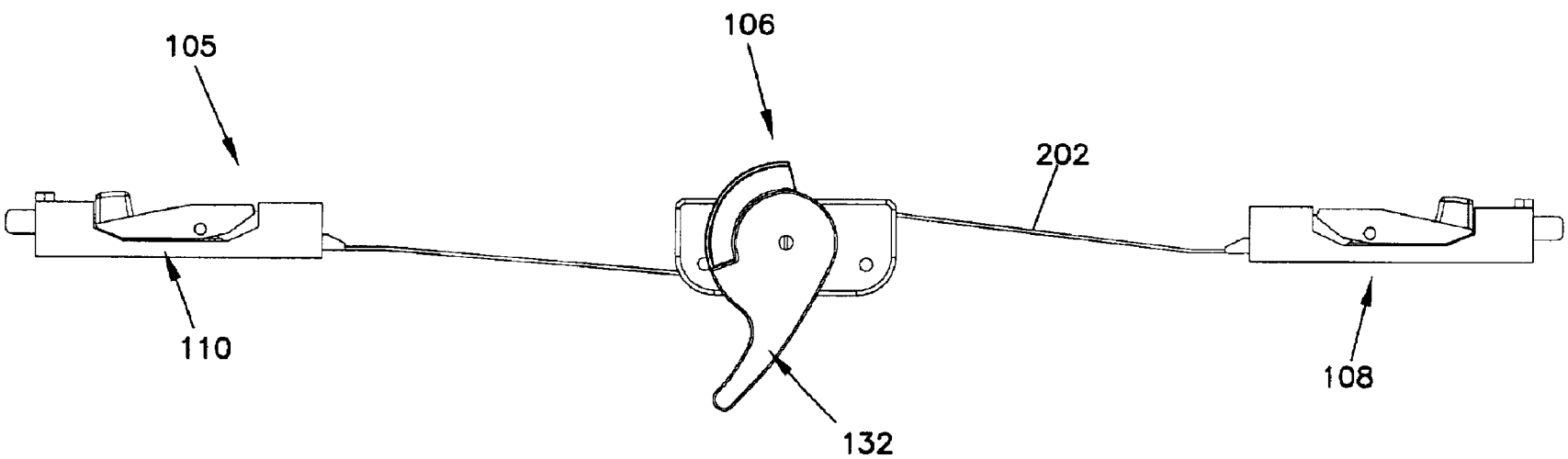
FIG. 14 is a top view of a tilt latch assembly in the mid position according to the principles of the present invention.
Figure 15:
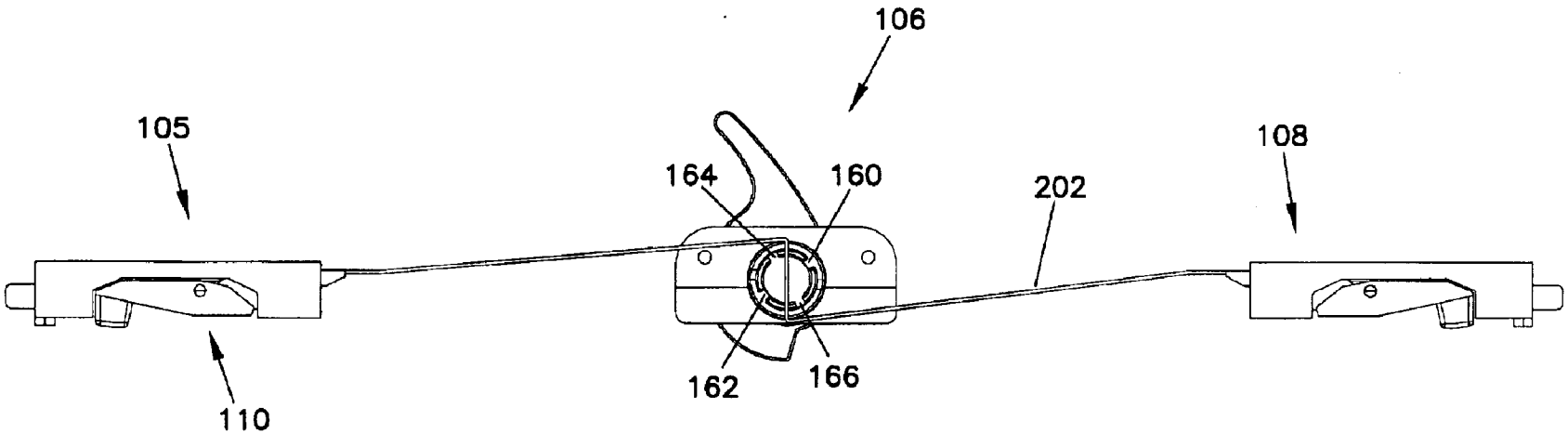
FIG. 15 is a bottom view of a tilt latch assembly in the mid position according to the principles of the present invention.
Figure 16:
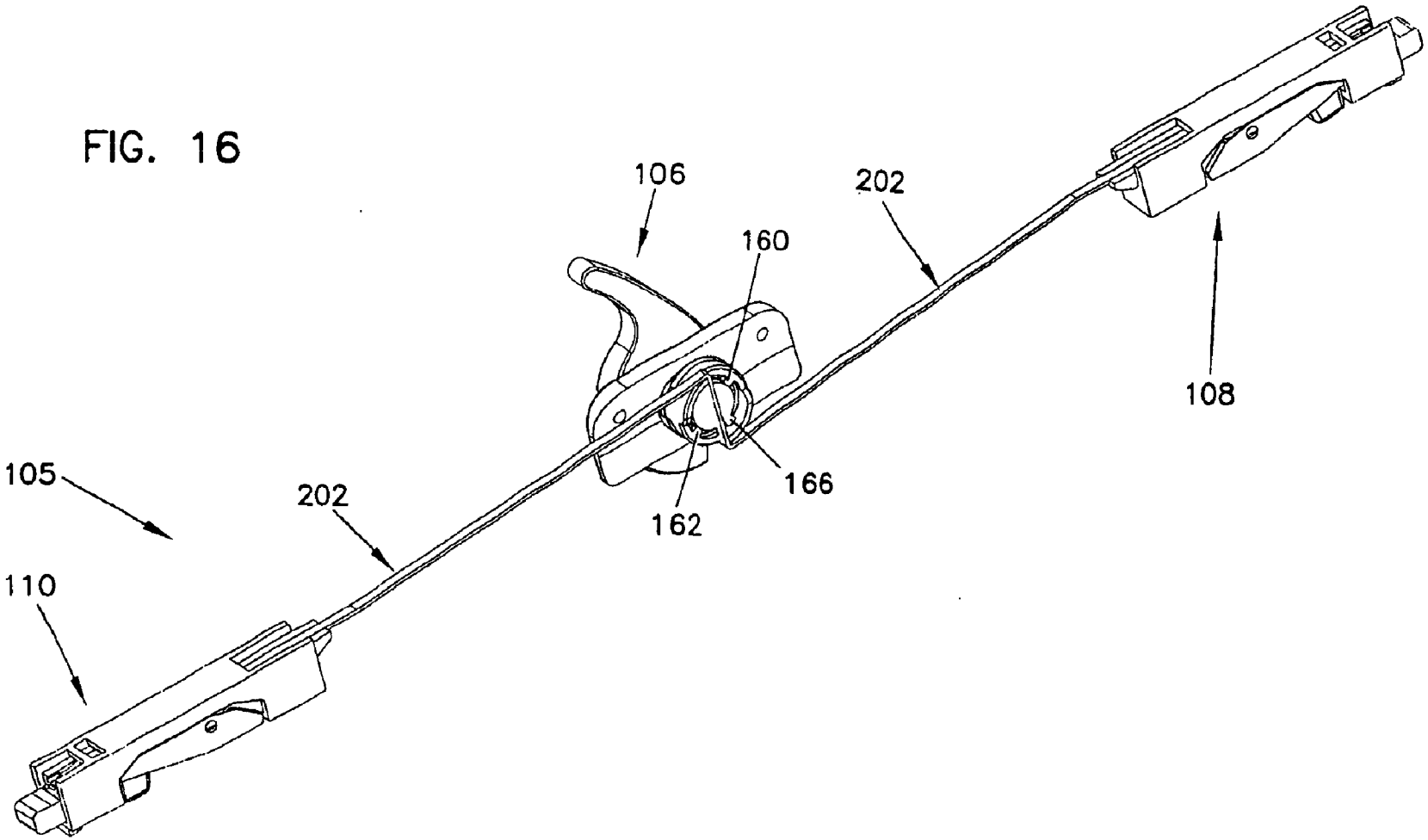
FIG. 16 is a bottom perspective view of a tilt latch assembly in the mid position according to the principles of the present invention.

FIGS. 14–16 show different views of the tilt latch assembly 105 in the "mid" position wherein the handle 132 has been rotated approximately 70 degrees counterclockwise as viewed from FIG. 14. In this position the shaft 134 has also rotated with the handle. However, the lock 106 is in the null zone because the cable tie 202 has not substantially moved despite rotation of the handle 132. The cable tie 202 has not moved because the cogs 164 and 166 have not yet made contact with the cog engaging surfaces 160 and 162. The position of the various components of the tilt latches 108 and 110 have not changed as compared to FIGS. 11–13.

Turning briefly to FIGS. 7 and 8, a discussion of the interaction of the torsion spring 138 with the handle 132 is appropriate. When the handle is in the locked position as shown in FIG. 7, the spring end 146 is situated on the surface 149. That is, the spring end 146 is not yet in the notch 141. As the handle is rotated from the locked position until nearing the unlocked position, the spring end 146 of the lock 106 moves along surface 149 until it rides over the detent 143 resting in notch 141 at a point just before 135 degrees rotation from the initial locked position (about 129 degrees from the initial locked position). In this unlocked position, the spring end 146 is situated between the detent 143 and the stopping surface 147 as shown in FIG. 8. At this point further rotation of the handle away from the locked position results in torsion being applied to the torsion spring 138, thereby biasing the handle 132 to return to the unlocked position.

Figure 17:
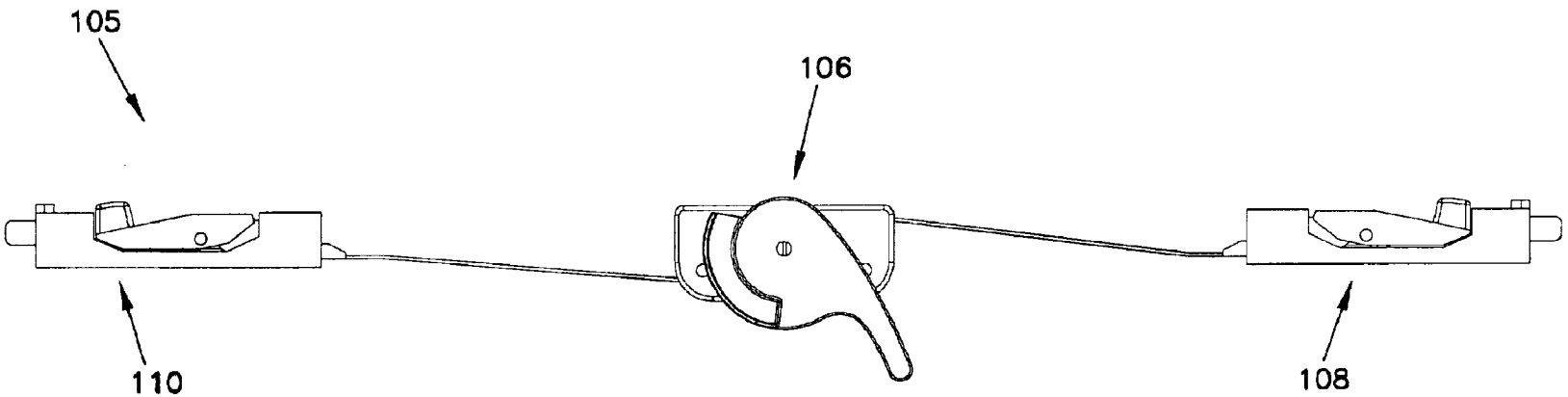
FIG. 17 is a top view of a tilt latch assembly in the unlocked position according to the principles of the present invention.
Figure 18:
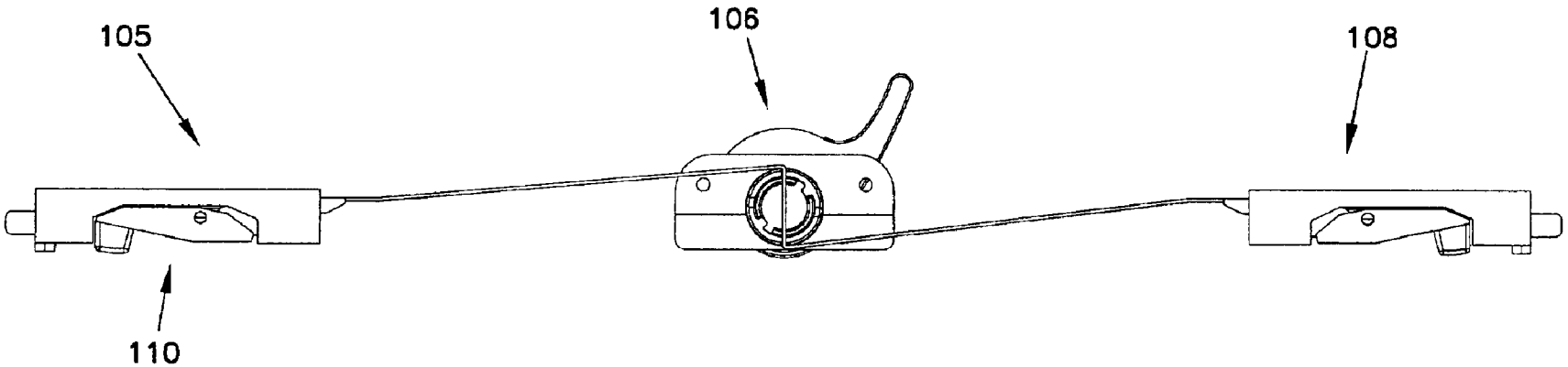
FIG. 18 is a bottom view of a tilt latch assembly in the unlocked position according to the principles of the present invention.
Figure 19:
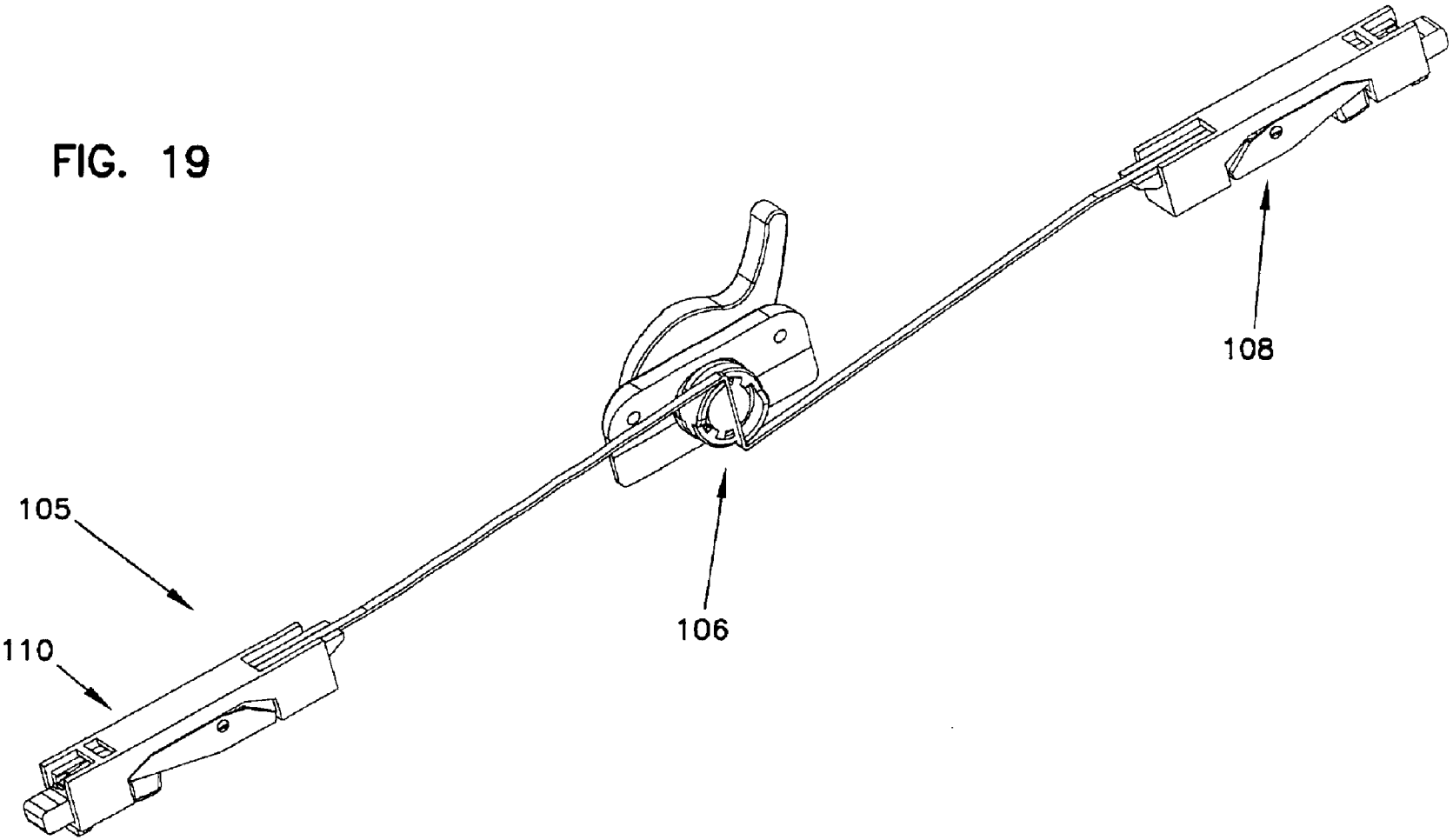
FIG. 19 is a bottom perspective view of a tilt latch assembly in the unlocked position according to the principles of the present invention.

FIGS. 17–19 show different views of the tilt latch assembly 105 in the unlocked position wherein the handle has moved 135 degrees from the initial locked position. At this unlocked position, the handle has disengaged from the keeper on the upper sash so that the lower sash releases from the upper sash so that the sashes can slide either up or down. As noted above, just before 135 degrees (just before arriving at the unlocked position), the handle passes detent 143 and it is now in a spring-loaded position to limit is freedom of motion. Further motion beyond the 135 degree position will have resistance from the torsion spring 138 at the lock and the compression spring 178 at the latches. At the 135 degree unlocked position, the lock is at the edge of the null zone because the cogs 164 and 166 have now made contact with the cog engaging surfaces 160 and 162 so that further rotation of the handle beyond 135 degrees will result in rotation of the drive member 136 which will in turn result in movement of both ends of cable tie 202 in a direction toward the lock 106.

Figure 20:
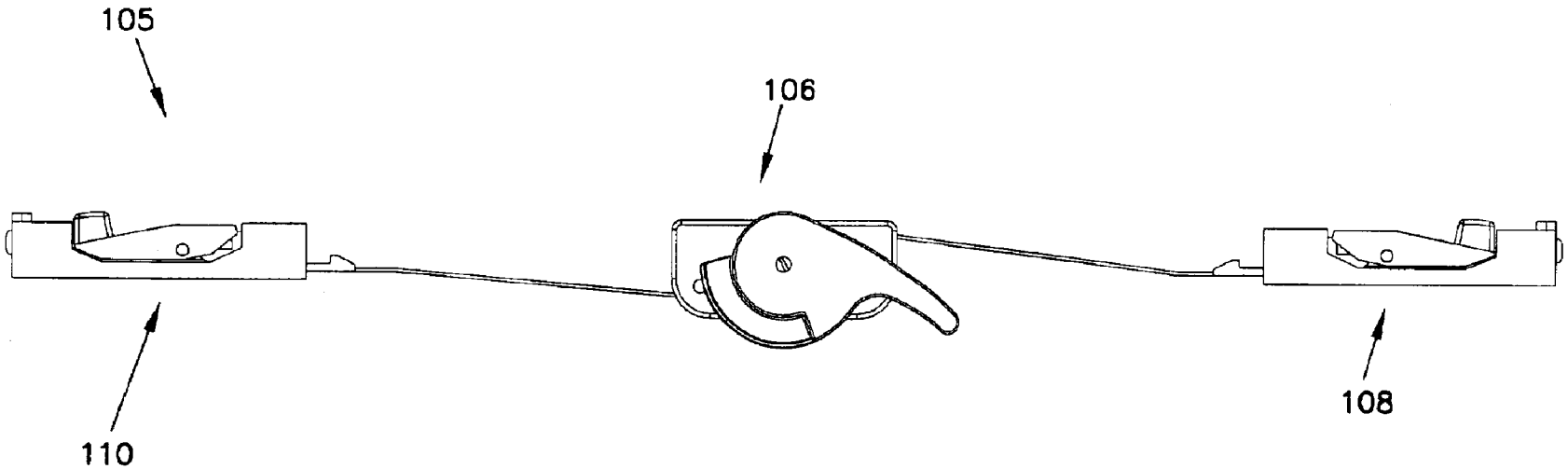
FIG. 20 is a top view of a tilt latch assembly in the slide position according to the principles of the present invention.
Figure 21:
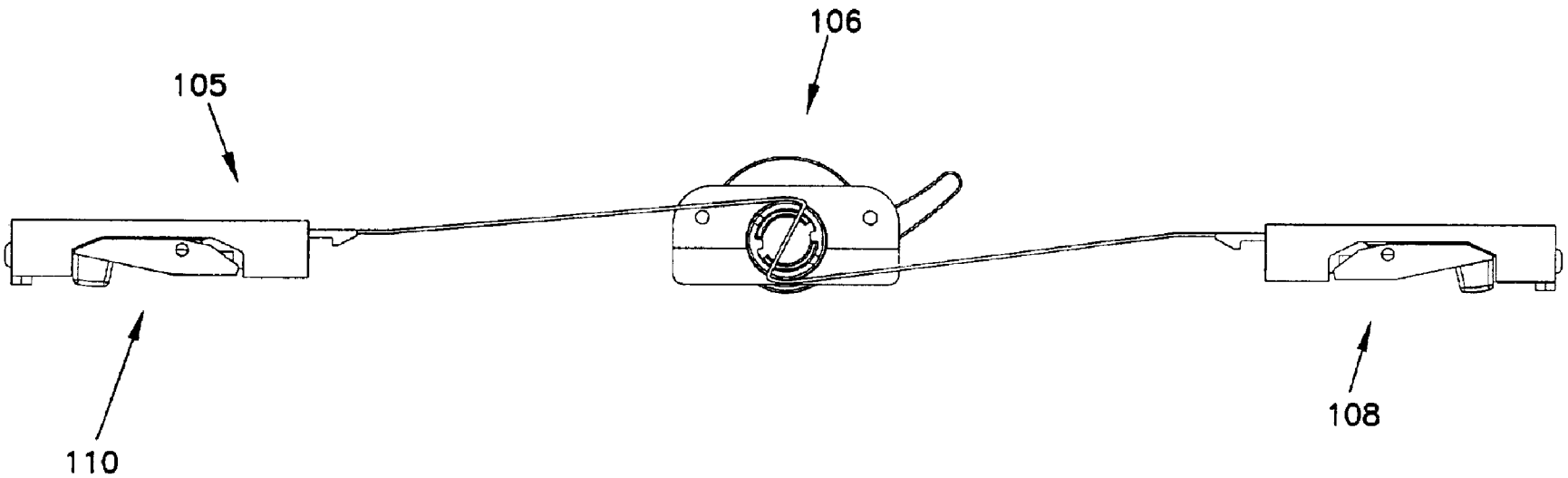
FIG. 21 is a bottom view of a tilt latch assembly in the slide position according to the principles of the present invention.
Figure 22:
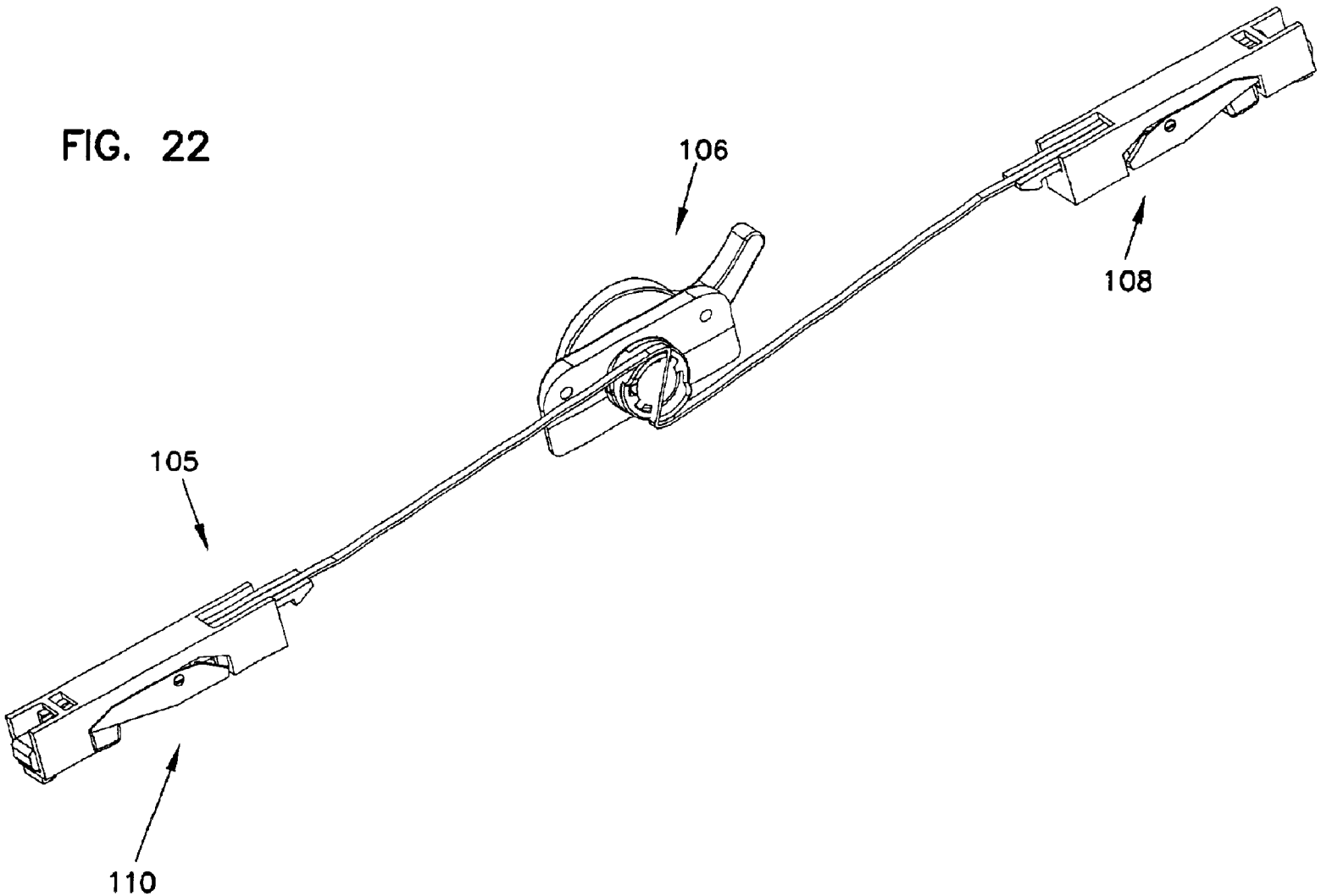
FIG. 22 is a bottom perspective view of a tilt latch assembly in the slide position according to the principles of the present invention.

FIGS. 20–22 show different views of the tilt latch assembly 105 in a "slide" position at about 162 degrees rotation from the original locked position. During the previous 27 degrees of handle movement (previous to the 162 degree slide position), the lever spring 175 has been increasingly deflecting as it moves up the ramp 177 of the slider member. The energy created by the deflection of the lever spring 175 will allow the button 176 to snap out from the retracted position to the protruding position. In the slide position, the slider locking surface 200 of the lever member 174 is allowed to move into contact with the tapered incline 205 of the slider member 172.

Figure 23:
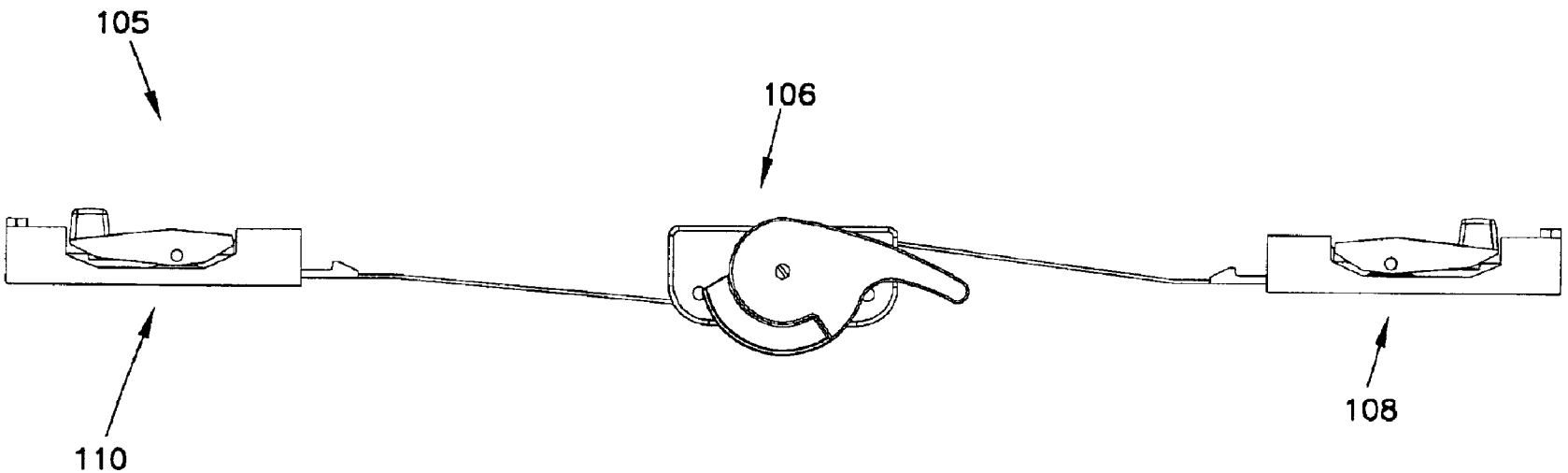
FIG. 23 is a top view of a tilt latch assembly in the trip position according to the principles of the present invention.
Figure 24:
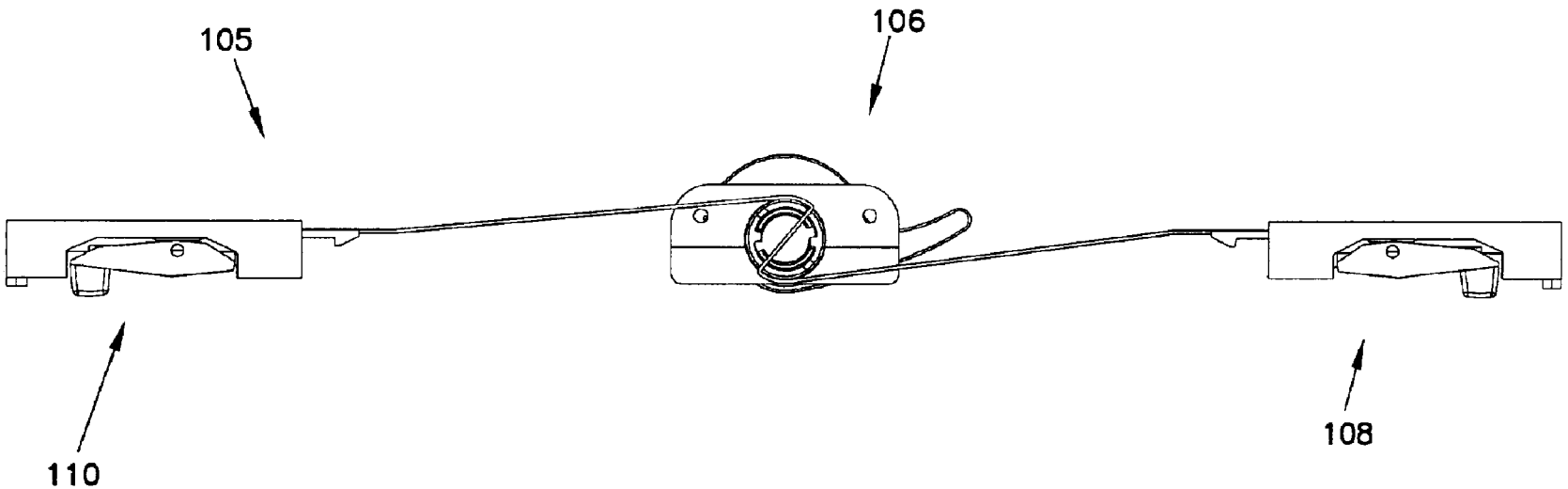
FIG. 24 is a bottom view of a tilt latch assembly in the trip position according to the principles of the present invention.
Figure 25:
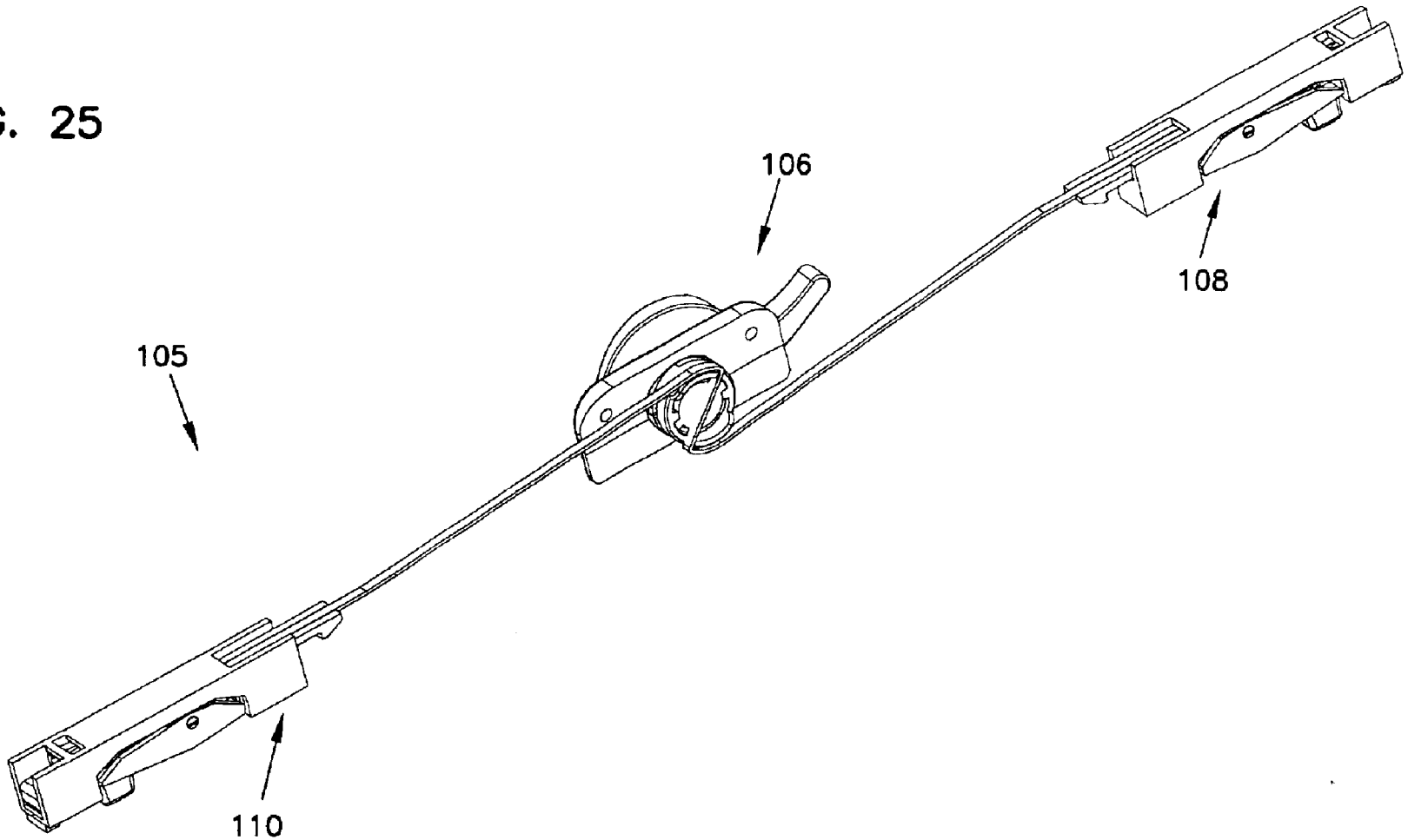
FIG. 25 is a bottom perspective view of a tilt latch assembly in the trip position according to the principles of the present invention.

FIGS. 23–25 show different views of the tilt latch assembly 105 in the "trip" position at about 175 degrees of rotation from the original locked position. At this point, the lever member 174 has moved off the tapered incline 205 and the button 176 is free to move to its final protruding position. The latch ends 184 and 185 have now moved far enough that the sash is free to tilt out of the frame on its lower pivot pins.

Figure 26:
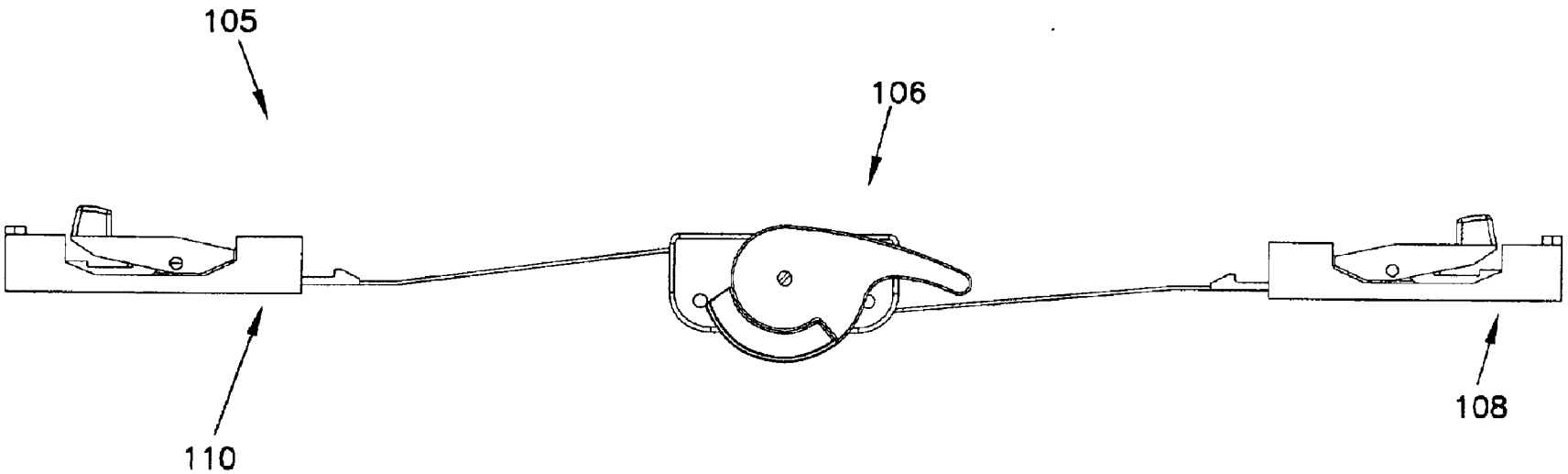
FIG. 26 is a top view of a tilt latch assembly in the open/tilt position according to the principles of the present invention.
Figure 27:
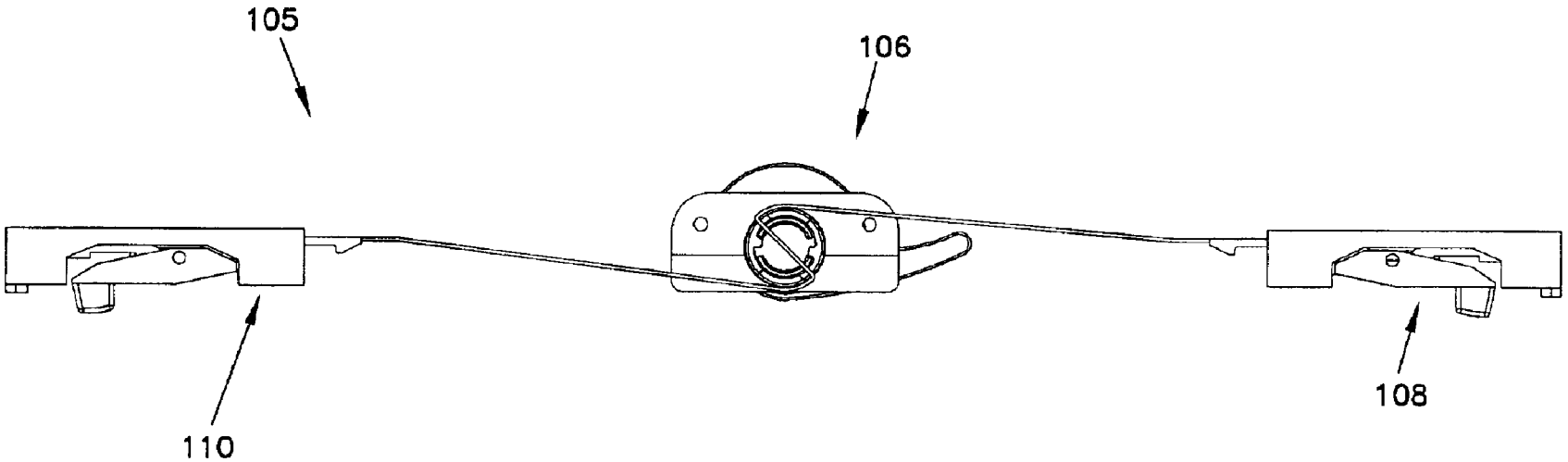
FIG. 27 is a bottom view of a tilt latch assembly in the open/tilt position according to the principles of the present invention.
Figure 28:
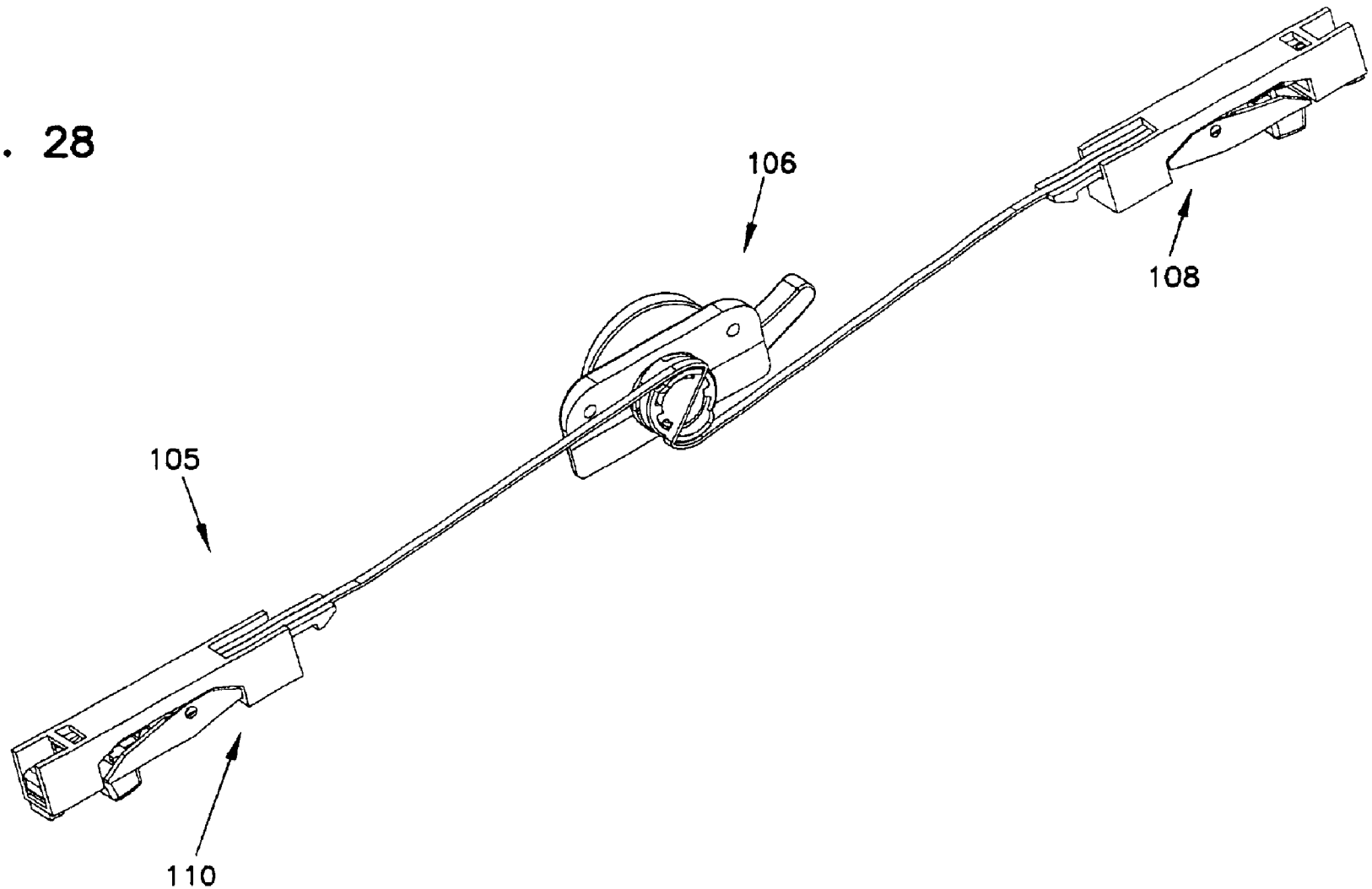
FIG. 28 is a bottom perspective view of a tilt latch assembly in the open/tilt position according to the principles of the present invention.

FIGS. 26–28 show different views of the tilt latch assembly 105 in the "open/tilt" position at about 180 degrees from the original locked position. In this position, the tie cable 202 has moved sufficient distance to pull the latch ends 184 and 185 in and to allow the slider locking surface 200 of the lever member 174 to engage with the surface 203 on the slider member 172 and keep the slider member 172 in the retracted position. The lower sash to which this assembly 105 is attached is now free to be tilted for cleaning.

Figure 29:
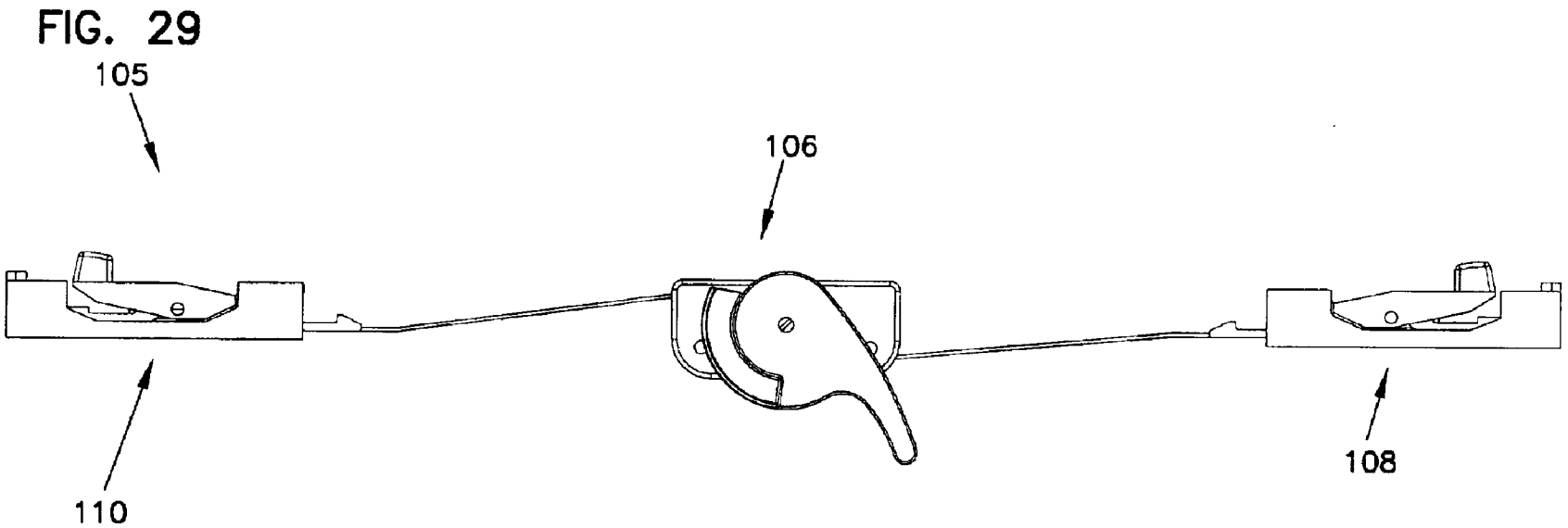
FIG. 29 is a top view of a tilt latch assembly in the release position according to the principles of the present invention.
Figure 30:
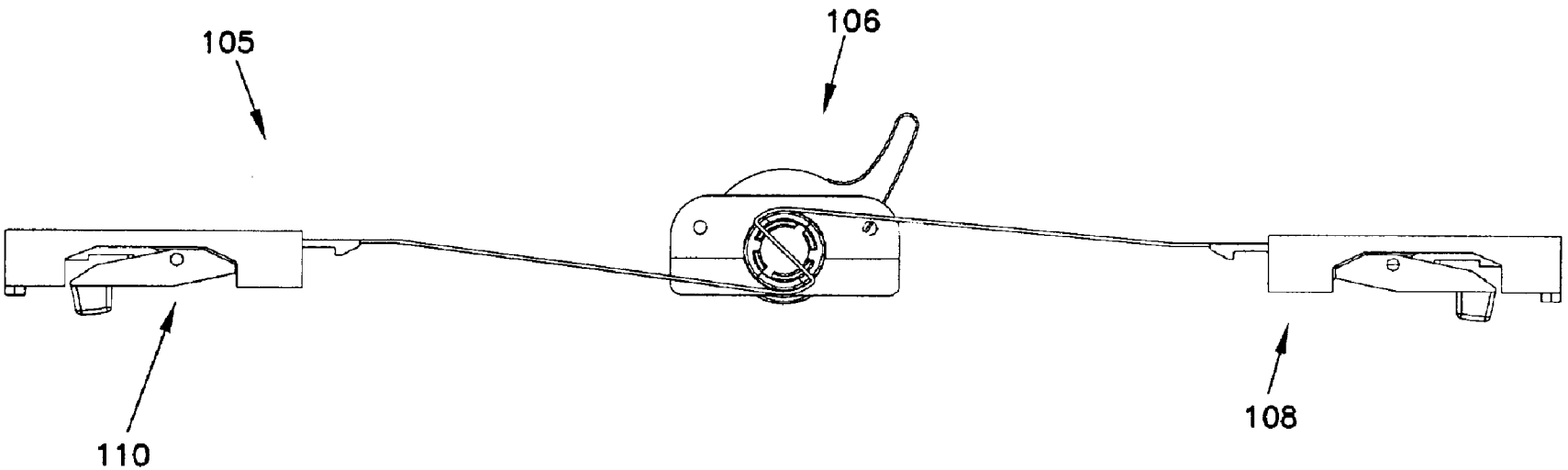
FIG. 30 is a bottom view of a tilt latch assembly in the release position according to the principles of the present invention.
Figure 31:
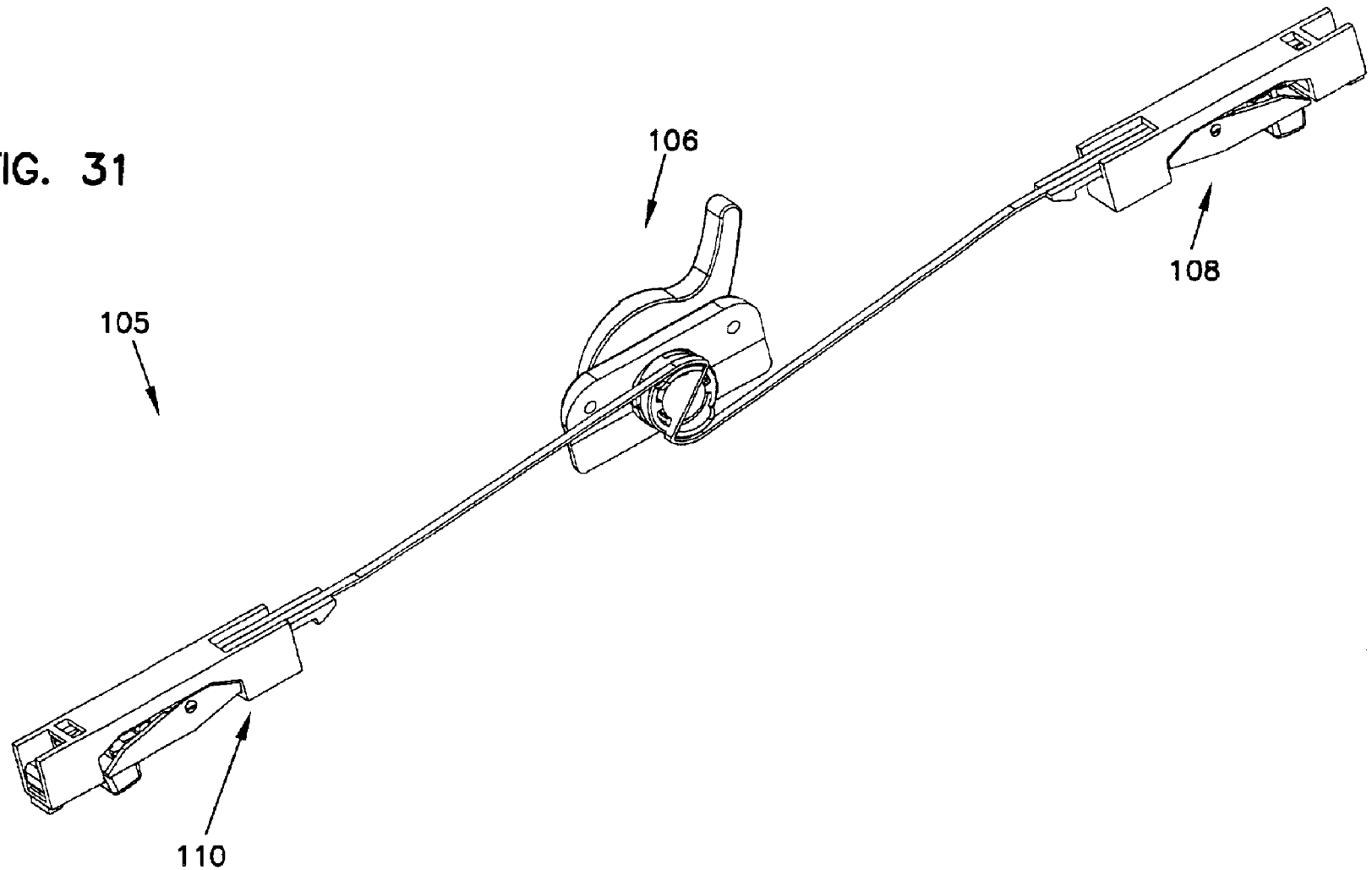
FIG. 31 is a bottom perspective view of a tilt latch assembly in the release position according to the principles of the present invention.

FIGS. 29–31 show different views of the tilt latch assembly 105 in the "released" position at about 135 degrees from the original locked position. This is the position the handle will assume when the actuation force applied by the operator is released from the handle. The return of the handle from the "open/tilt" position to the "released" position is caused by the force of the torsion spring 138 between the base 130 and the handle 132.

After the tilting operation is completed the lower sash is returned to a non-tilting position. The buttons 176 and 177 strike the upper sash resulting in movement of the slider locking surface 200 to a position in which it no longer prevents slider member 172 from moving in the extending direction. That is, slider locking surface 200 has moved off of surface 203 and onto incline 205 for retraction. The slider member 172 then moves in the direction of the jamb (extending direction) under force of spring 178.

This automatic return of the latch ends 184 and 185 into engagement with the frame and/or jambliner is advantageous because the operator no longer has to manually cause such a position. The operator merely pivots the sash from the tilted to the non-tilted position and the tilt latch assembly of the present invention causes automatic engagement of the latch ends with the frame and/or jambliner.

Schematic Diagrams of Part-By-Part Movements

FIGS. 32A–32F show diagrams that give an overview of the embodiment described above broken down into the function that each component contributes to the whole assembly. The time axis is made to scale simulating the action of a user operating the handle at a consistent speed.

The movement axis is shown in a relative scale to each components deflection, translation or rotation. The specifics of part interaction are not shown here. The section labeled "component location within key positions" show that interaction.

Figure 32A:
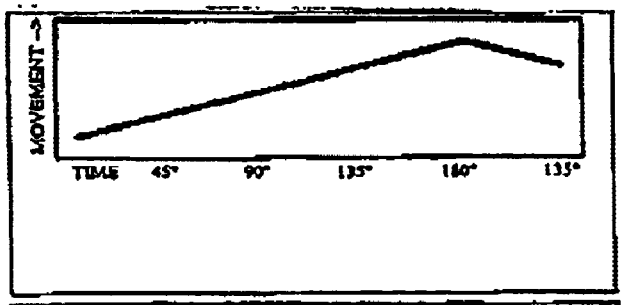
FIGS. 32A–32F are part-by-part movement diagrams for specific components.
Figure 32B:
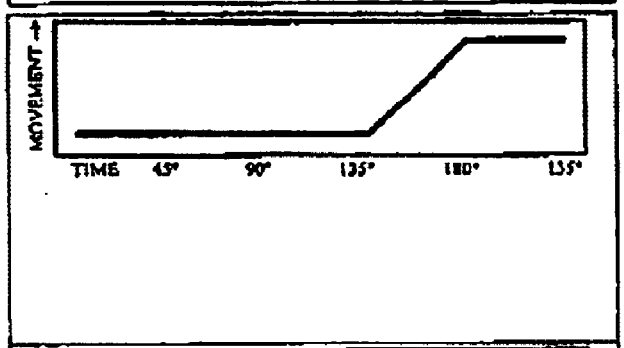
Figure 32C:
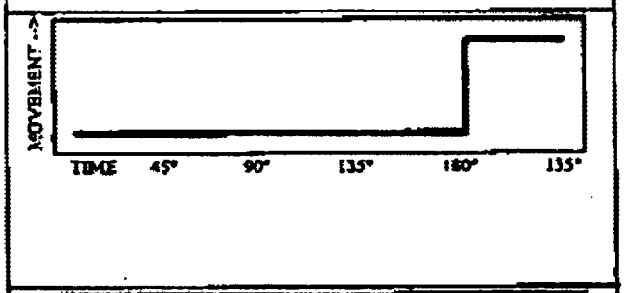
Figure 32D:
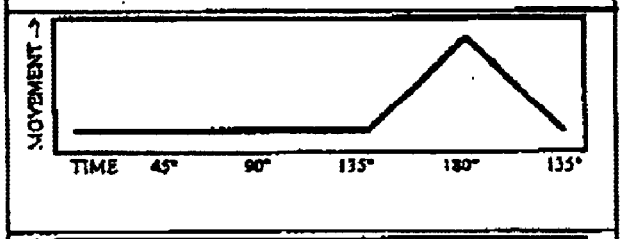
Figure 32E:
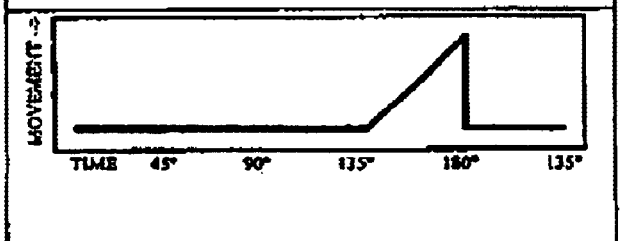
Figure 32F:
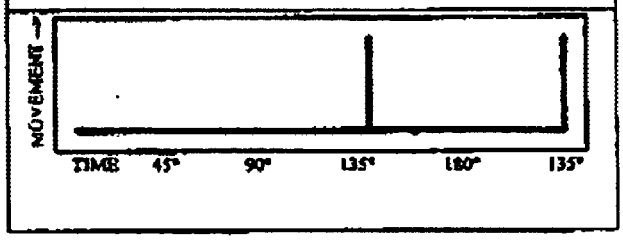

FIGS. 32A–32F detail part-by-part movement diagrams for specific components detailed herein. In 32A, the movement per time of handle 132 is shown. The 180° angular movement by the handle, which locks the lower sash and the upper sash together, is directly controlled by the operator. FIG. 32B shows the part-by-part movement of the slider member 172 and driver 136. Slider member 172 has a 0.402-inch linear motion that engages the sash of the frame to resist tilting of the sash. The driver member 136 has an angular movement of 45° driven by the handle via a single cog system. FIG. 32C shows part-by-part movement of lever button 176. The lever button 176 shows mostly linear movement (9° or 0.236-inch) of the button that will trigger the latch ends into the frame upon closure of the sash. FIG. 32D shows part-by-part movement of the torsion spring 138. A 45° angular movement that gives the handle its spring-loaded position after the sash is in the tilt mode is shown. FIG. 32E shows part-by-part movement of the lever spring 175. The lever spring 175 shows an 8° movement and shows the loading of the spring feature of the lever that gives it the energy to push the lever button 176 out of the sash. FIG. 32F shows part-by-part movement of the torsion spring 138 tab detent. The deflection of 0.06-inch for the torsion spring 138 tab detent keeps the handle in a spring-loaded condition of 135° when not being pushed on by user intervention.

Component location within key positions

| | Lock-0 | Detent-129 | Unlatch-135 | Slide-162 | Trip-175 | Open/Tilt-180 | Released-135 |
|---|---|---|---|---|---|---|---|
| extension | 0.388 | 0.388 | 0.388 | 0.1 | −0.006 | −0.2 | −0.2 |
| angle | 102 | 102 | 102 | 102 | 95.2 | 90 | 90 |
| lat_06 | 0.385 | 0.385 | 0.385 | 0.225 | 0.296 | 0.35 | 0.35 |
| piv_ang1 | 0 | 129 | 135 | 162 | 175 | 180 | 135 |
| piv_ang2 | 0 | 0 | 0 | 27 | 40 | 45 | 45 |
| spr_01 | 0 | 0 | 0 | 27 | 40 | 45 | 0 |
| spr_03 | 0.725 | 0.725 | 0.725 | 0.701 | 0.681 | 0.675 | 0.725 |
| tor_sp_03 | 0.1 | 0.077 | 0.1 | 0.1 | 0.1 | 0.1 | 0.1 |

The chart shown above is the actual control of the CAD model that simulates the movement of the entire handle and tilt latch. The data is shown below in graphical format.

Figure 33:
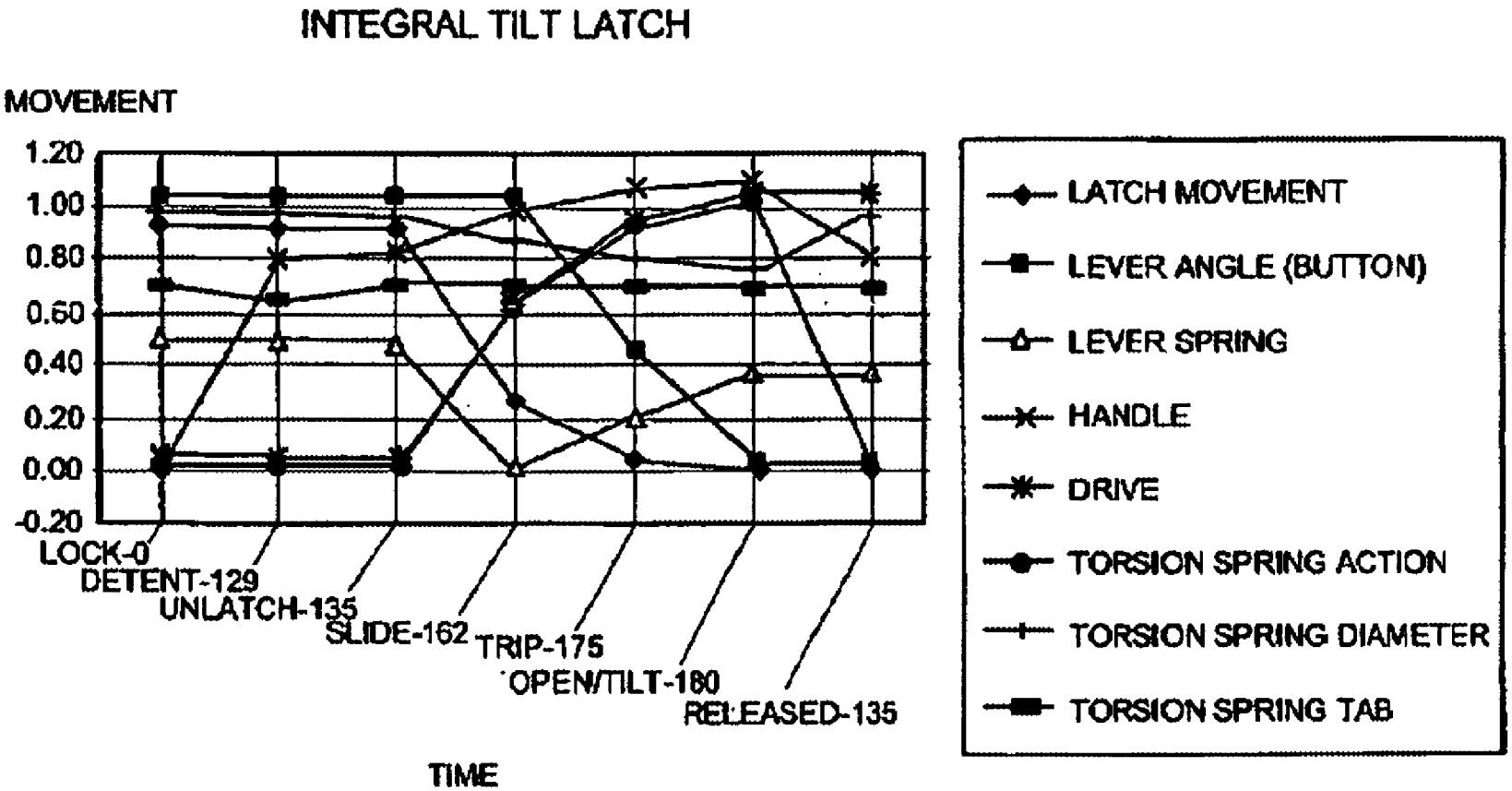
FIG. 33 is a chart showing the position of components relative to key timing points along the actuation of the tilt latch mechanism.

FIG. 33 shows a chart for the integral tilt latch in terms of movement versus time.

This chart shows graphically the relative positions of components relative to key timing points along the actuation of the tilt latch mechanism. The horizontal axis represents time, however it is not to scale. The numeric values after each of the labels cooresponds to the actual angular movement of the handle.

The above specification provides a complete description of one or more embodiments of the invention, but the invention is not limited to those embodiments. Since many embodiments in the invention can be made without departing from the spirit and scope of the invention, the invention resides in the claims hereafter appended.

We claim:

1. A tilt latch assembly for use on a hung window comprising:

(a) a lock comprising:

(i) a base adapted to be attached to a sash;

(ii) a handle rotatably connected to the base, the handle having a first position and a second position;

(iii) a tilt latch actuating mechanism connected to the handle wherein the tilt latch actuating mechanism is adapted to receive an extensible member, wherein the tilt latch actuating mechanism is adapted to cause the extensible member to move in a direction toward the lock as the handle is rotated from the first position to the second position;

(b) right and left tilt latches each comprising:

(i) an housing adapted to be mounted to a window sash;

(ii) a slider member slidably received by the housing and having an inside end adapted to be connected to said extensible member and a latch end opposite the inside end, the latch end adapted to engage one or both of a groove in a window frame and a component attached to a window frame, wherein the slider member is slidable in a extending direction and in an opposite nonextending direction;

(iii) a trigger member connected to the housing, the trigger member having a button, wherein the button is movable in a pivotal direction substantially perpendicular to the movement of the slider member, the button having a protruding position wherein the button is protruding from the housing and a retracted position wherein the button is nearer the housing than in the protruding position; and (c) said extensible member having a first end and an opposite second end and a middle section between the first and second ends, wherein the first end is attached to the inside end of the slider member of the left tilt latch, wherein the second end is attached to the inside end of the slider member of the right tilt latch, and wherein the middle section is received by the tilt latch actuating mechanism, wherein rotation of the handle from the first position to the second position results in movement of the first and second ends of the extensible member in a direction toward the lock, thereby causing the latch ends to move in their respective nonextending directions and resulting in a force on the trigger members in a direction toward the protruding position, and wherein movement of the trigger members from the protruding position to the retracted position results in a force on each of the slider members in their respective extending directions.

2. A tilt latch assembly for use on a hung window comprising:

(a) a lock comprising (i) a base adapted to be attached to a window sash, wherein the base defines a first opening;

(ii) a shaft having a longitudinal axis, the shaft including an upper end and a lower end, wherein the lower end includes at least one cog protruding transversely to the longitudinal axis, and wherein the upper end of the shaft is received by the opening in the base;

(iii) a handle connected to the upper end of the shall wherein rotation of the handle results in rotation of the shaft around the longitudinal axis of the shaft, wherein the handle has at least a locked position in which a first position of the handle is configured to be positioned to engage an upper sash, an unlocked position in which the first portion of the handle is configured to be positioned out of engagement with the upper sash, and a tilt position in which the first portion of the handle is configured to be positioned out of engagement with the upper sash;

(iv) a torsion spring having a first end and a second end, wherein the first end is connected to the base and the second end is free when the handle is in the locked position, and the second end is connected to the handle or the shaft when the handle is in the detent position or in the tilt position, so that rotation of the handle from the locked position to the unlocked position, prior to reaching the detent position, results in no substantial increase in torque on the torsion spring; and (v) a drive member defining a second opening wherein the shaft is received by the second opening, and wherein the drive member includes a drive surface adapted for engaging an extensible member, and wherein the drive member includes a cog engaging surface, wherein rotation of the handle results in rotation of the shaft which results in movement of the cog through a null zone in which the cog is not engaged with the cog engaging surface and wherein further rotation of the handle results in engagement of the cog with the cog engaging surface resulting in rotation of the drive member;

(b) right and left tilt latches each comprising:

(i) housing having a first spring engagement surface, the housing adapted to be mounted to a window sash;

(ii) slider member slidably received by the housing and having an inside end adapted to be connected to said extensible member and a latch end opposite the inside end, the latch end adapted to engage one or both of a groove in a window frame and a component attached to a window frame, wherein the slider member is slidable in a extending direction and in an opposite nonextending direction, and wherein the slider member comprises a second spring engagement surface substantially perpendicular to the movement of the slider member and substantially parallel to the first spring engagement surface;

(iii) a spring positioned between the first and second spring engagement surfaces;

(iv) a lever member pivotally connected to the housing at a pivot position between a button end of the lever member and an opposite second end of the lever member, wherein the lever member includes a button on the button end capable of extending outside the housing in a pivotal direction substantially perpendicular to the movement of the slider member, the button having a retracted position and a protruding position, and the lever member second end having a slider locking surface substantially perpendicular to the movement of the slider member;

(v) wherein movement of the slider member in the nonextending direction causes the spring to be compressed between the first and second spring engagement surfaces thereby providing a force on the slider member in the extending direction, and wherein movement of the slider member in the nonextending direction also results in pivotal movement of the lever member such that the slider locking surface engages the slider member to prevent movement of the slider member in the extending direction, and wherein the pivotal movement of the lever member also results in movement of the button into the protruding position, and wherein movement of the button from the protruding position to the retracted position results in movement of the slider locking surface out of engagement with the slider member, thereby resulting in movement of the slider member in the extending direction under the force of the spring; and (c) said extensible member having a first end and an opposite second end and a middle section between the first and second ends, wherein the first end is attached to the inside end of the slider member of the left tilt latch, wherein the second end is attached to the inside end of the slider member of the right tilt latch, and wherein the middle section is received by the drive member of the lock, wherein rotation of the handle from the first position to the second position results in movement of the first and second ends of the extensible member in a direction toward the lock, thereby causing the latch ends to move in their respective unlocking directions and resulting in a force on the trigger members in a direction toward the protruding position, and wherein movement of the trigger members from the protruding position to the retracted position results in a force on each of the slider members in their respective extending directions.

3. A hung window and tilt latch assembly comprising:

(a) a frame;

(b) a sash slidably received by the frame, the sash configured to tilt from an untilted position coplanar with the frame, to a tilted position wherein the sash pivots to a position that is out of the plane of the frame;

(c) a lock comprising:

(i) a base attached to the sash;

(ii) a handle rotatably connected to the base, the handle having a first position and a second position;

(iii) a tilt latch actuating mechanism connected to the handle wherein the tilt latch actuating mechanism is adapted to receive an extensible member, wherein the tilt latch actuating mechanism is adapted to cause the extensible member to move in a direction toward the lock as the handle is rotated from the first position to the second position;

(d) right and left tilt latches each comprising:

(i) an housing attached to the sash;

(ii) a slider attached to the extensible member, the slider capable of linear longitudinal movement that is perpendicular to the sliding movement of the lower sash in the frame, the slider comprising a latch end having an extended position wherein the latch end engages with the frame when in the extended position, and a nonextended position wherein the latch end is disengaged from the frame;

(iii) a button having a protruding position in which the button is protruding from the housing in a pivotal direction perpendicular to the linear longitudinal movement of the slider, and a retracted position in which the button is retracted from the protruding position;

(iv) a spring loaded mechanism connected to the slider and the button wherein movement of the button from the protruding position to the retracting position causes the spring loaded mechanism to apply force to the slider in the direction of the extended position whereby the latch end is caused to engage the frame and prevent the lower sash from moving to the tilted position.

4. A hung window and tilt latch assembly comprising:

(a) a frame;

(b) a sash slidably received by the frame, the sash having an upper rail, the sash configured to tilt from an untilted position coplanar with the frame, to a tilted position wherein the sash pivots to a position that is out of the plane of the frame wherein the upper rail is outside the plane of the frame;

(c) a lock comprising:

(i) a base attached to the upper rail of the sash;

(ii) a handle rotatably connected to the base, the handle having a first position and a second position;

(iii) a tilt latch actuating mechanism connected to the handle wherein the tilt latch actuating mechanism is adapted to receive an extensible member, wherein the tilt latch actuating mechanism is adapted to cause the extensible member to move in a direction toward the lock as the handle is rotated from the first position to the second position;

(d) right and left tilt latches each comprising:

(i) an housing mounted to the sash;

(ii) a slider member slidably received by the housing and having an inside end adapted to be connected to said extensible member and a latch end opposite the inside end, wherein the slider member is slidable in an extending direction and in an opposite nonextending direction, wherein the latch end is adapted to engage the frame when the slider member is moved in the extending direction;

(iii) a trigger member connected to the housing, the trigger member having a button, wherein the button is movable in a pivotal direction substantially perpendicular to the sliding movement of the slider member, the button having a protruding position wherein the button is protruding from the housing and a retracted position wherein the button is nearer the housing than in the protruding position; and (e) said extensible member having a first end and an opposite second end and a middle section between the first and second ends, wherein the first end is attached to the inside end of the slider member of the left tilt latch, wherein the second end is attached to the inside end of the slider member of the right tilt latch, and wherein the middle section is received by the tilt latch actuating mechanism, wherein rotation of the handle from the first position to the second position results in movement of the first and second ends of the extensible member in a direction toward the lock, thereby causing the latch ends to move in their respective nonextending directions and thereby disengage from the frame, and causing a force on the buttons of the trigger members toward the protruding position, and wherein movement of the trigger members from the protruding position to the retracted position results in movement of each of the latch ends in their respective extending directions and into engagement with the frame.

5. A hung window and tilt latch assembly comprising:

(a) a frame including four frame members wherein at least two of the frame members define longitudinal grooves;

(b) a sash slidably received by the frame, the sash having an upper rail, the sash configured to tilt from an untilted position coplanar with the frame, to a tilted position wherein the sash pivots to a position that is out of the plane of the frame wherein the upper rail is outside the plane of the frame;

(c) a lock comprising (i) a base adapted to be attached to a window sash, wherein the base defines a first opening;

(ii) a shaft having a longitudinal axis, the shaft including an upper end and a lower end, wherein the lower end includes at least one cog protruding transversely to the longitudinal axis, and wherein the upper end of the shaft is received by the opening in the base;

(iii) a handle connected to the upper end of the shaft wherein rotation of the handle results in rotation of the shaft around the longitudinal axis of the shaft, wherein the handle has at least a locked position in which a first portion of the handle is configured to be positioned to engage an upper sash, an unlocked position in which the first portion of the handle is configured to be positioned out of engagement with the upper sash, and a tilt position in which the first portion of the handle is configured to be positioned out of engagement with the upper sash;

(iv) a torsion spring having a first end and a second end, wherein the first end is connected to the base and the second end is connected to one or both from the group comprising the handle and the shaft so that rotation of the handle from the locked position to the unlocked position and from the unlocked position to the tilt position results in increased torsion in the torsion spring resulting in a force applied against the handle in the direction toward the locked position; and (v) a drive member defining a second opening wherein the shaft is received by the second opening, and wherein the drive member includes a drive surface adapted for engaging said extensible member, and wherein the drive member includes a cog engaging surface, wherein rotation of the handle results in rotation of the shaft which results in movement of the cog through a null zone in which the cog is not engaged with the cog engaging surface and wherein further rotation of the handle results in engagement of the cog with the cog engaging surface resulting in rotation of the drive member;

(d) right and left tilt latches each comprising:

(i) housing having a first spring engagement surface, the housing adapted to be mounted to a window sash;

(ii) slider member slidably received by the housing and having an inside end adapted to be connected to said extensible member and a latch end opposite the inside end, the latch end adapted to engage one or both of a groove in a window frame and a component attached to a window frame, wherein the slider member is slidable in an extending direction and in an opposite nonextending direction, and wherein the slider member comprises a second spring engagement surface substantially perpendicular to the sliding movement of the slider member and parallel to the first spring engagement surface;

(iii) a spring positioned between the first and second spring engagement surfaces;

(iv) a lever member pivotally connected to the housing at a pivot position between a button end of the lever member and an opposite second end of the lever member, wherein the lever member includes a button on the button end capable of protruding outside the housing in a pivotal direction substantially perpendicular to the sliding movement of the slider member, the button having a retracted position and a protruding position, and the lever member second end having a slider locking surface substantially perpendicular to the sliding movement of the slider member;

(v) wherein movement of the slider member in the nonextending direction causes the spring to be compressed between the first and second spring engagement surfaces thereby providing a force on the slider member in the extending direction, and wherein movement of the slider member in the nonextending direction also results in pivotal movement of the lever member such that the slider locking surface engages the slider member to prevent movement of the slider member in the extending direction, and wherein the pivotal movement of the lever member also results in movement of the button into the protruding position, and wherein movement of the button from the protruding position to the retracted position results in movement of the slider locking surface out of engagement with the slider member, thereby resulting in movement of the slider member in the extending direction under the force of the spring; and (e) said extensible member having a first end and an opposite second end and a middle section between the first and second ends, wherein the first end is attached to the inside end of the slider member of the left tilt latch, wherein the second end is attached to the inside end of the slider member of the right tilt latch, and wherein the middle section is received by the drive member of the lock, wherein rotation of the handle from the first position to the second position results in movement of the first and second ends of the extensible member in a direction toward the lock, thereby causing the latch ends to move in their respective nonextending directions and resulting in a force on the trigger members in a direction toward the protruding position, and wherein movement of the trigger members from the protruding position to the retracted position results in a force on each of the slider members in their respective extending directions.

* * * * *